US006485878B2

(12) United States Patent
Nagase et al.

(10) Patent No.: US 6,485,878 B2
(45) Date of Patent: Nov. 26, 2002

(54) IMAGE FORMING METHOD

(75) Inventors: Tatsuya Nagase, Hachioji (JP); Meizo Shirose, Hachioji (JP); Asao Matsushima, Hachioji (JP); Kazuhisa Horiuch, Hachioji (JP); Hiroshi Yamazaki, Hachioji (JP); Hiroyuki Yamada, Hachioji (JP); Kaori Soeda, Hachioji (JP)

(73) Assignee: Konica Corporation (JP)

( * ) Notice: Subject to any disclaimer, the term of this patent is extended or adjusted under 35 U.S.C. 154(b) by 34 days.

(21) Appl. No.: 09/809,767

(22) Filed: Mar. 15, 2001

(65) Prior Publication Data

US 2001/0031417 A1 Oct. 18, 2001

(30) Foreign Application Priority Data

Mar. 16, 2000 (JP) ..... 2000-074147
Mar. 28, 2000 (JP) ..... 2000-088782
Mar. 30, 2000 (JP) ..... 2000-094475

(51) Int. Cl.[7] ..... G03G 13/20

(52) U.S. Cl. ..... 430/124; 399/330; 399/331; 399/333

(58) Field of Search ..... 430/124; 399/330, 399/331, 333

(56) References Cited

U.S. PATENT DOCUMENTS 5,589,313 A * 12/1996 Takezawa et al. ..... 430/122

* cited by examiner

*Primary Examiner*—Mark Chapman
(74) *Attorney, Agent, or Firm*—Bierman, Muserlian and Lucas

(57) ABSTRACT

An image forming method by developing an electrostatic latent image formed on a photoreceptor to form a toner image employing a developer comprising toner, transferring the toner image onto an image forming material, and fixing the transferred toner image employing a fixing unit, is disclosed.

The fixing unit is comprised of a heating roller and a pressure roller which is brought into contact with said heating roller, the heating roller is constituted of a cylinder having an interior diameter of from 10 to 70 mm and a wall thickness of from 0.1 to 2 mm comprised of a metal or a metal alloy, and a heating member being incorporated in the interior, a surface of the cylinder being covered with an elastic martial having an Asker hardness C of less than 70 degrees at a thickness of 0.1 to 30 mm, and the pressure roller is constituted of a metal cylinder whose surface is covered with an elastic material having an Asker hardness C of less than 80 degrees at a thickness of from 0.1 to 30 mm.

14 Claims, 5 Drawing Sheets

IMAGE FORMING METHOD

FIELD OF THE INVENTION

The present invention relates to an image forming method.

BACKGROUND OF THE INVENTION

In color toner images in which a desired color is formed by laminating toner layers having three primary colors (color layering), with the view of improving color reproduction properties, it is required that color matching be conducted by smoothing the surface (interface) of the toner layer surface of each color. In order to smooth the interlayer of said toner layers, it is advantageous to use a toner having a low melt viscosity during fixing. On the other hand, widely employed, as a system to fix color toner images, is a heating roller fixing system utilizing a fixing unit provided with a heating roller as well as with a pressure roller.

However, when color toner images, comprised of toners having a low melt viscosity, are fixed utilizing said heating roller fixing system, and subsequently the fixed image is peeled off from said heating roller, so-called offset phenomena tend to occur. In order to minimize said offset phenomena, a relatively large amount of silicone oil is applied to the surface of said heating roller so that adhesion between said heating roller and said toner is reduced.

However, in such a system, problems occur in which silicone oil which is applied to the surface of the heating roller is soaked into the transfer paper sheets (an image forming support) to result in degradation of writability of said transfer sheet, and in addition, said silicone oil adheres to the leading edge of the transfer sheet which is brought into contact with said heating roller. Further, when PET sheets, for overhead projection use, are employed as the image forming support, problems also occur in which said silicone oil remains on the surface of said PET sheet to result in stickiness.

When color images are fixed employing the heating roller system described above, no means has been known which sufficiently exhibits both color reproduction properties (smoothness of each color toner layer) and offsetting resistance (releasability in a fixing unit in which no silicone oil is supplied or only a very small amount of silicone oil is supplied).

Multicolor image forming methods include a method in which an electrostatic latent image corresponding to a color is formed on a latent image bearing body, and a multicolor image is formed by repeating the development and transfer process for each color. Said method, however, requires that said electrostatic latent image bearing support is subjected to repetition of development and transfer processes under the frequency of developing each color. Therefore, the rate of image formation is low compared to that of a single color image formation. Thus, when full-color images are formed, said rate is not more than ¼ of the single color rate.

Accordingly, when said method is utilized, it is difficult to increase the rate of full-color image formation.

On the other hand, methods, in which even full-color images are formed at high speed, include a method, generally called a tandem method, in which an electrostatic latent image bearing body corresponding to each color is provided, and an image formed on each body is transferred so as to form a full-color image.

In said method, since a latent image forming process, a development process, and a transfer process are formed for each color, the rate of image formation is the same as that of a single color formation. Thus, said method exhibits an advantage which makes it possible to achieve full-color image formation at high speed.

However, in said method, since each color image is formed utilizing an individual electrostatic latent image bearing body, it is required to stabilize the developed amount of each color to control the color balance. Further, since an image is formed by transferring a toner image formed on each electrostatic latent image bearing body onto an image support and subsequently by fixing the transferred image, problems occur in which when adhesion of any of color images onto said image support is different, image stability during fixing deteriorates.

The electrostatic latent image bearing body as previously described is commonly an electrophotographic photoreceptor, which is hereinafter referred occasionally to simply as a photoreceptor.

On the other hand, preferably employed as a fixing method is a so-called heating roll method due to the simplicity, and the like, of such a unit. In this fixing method, since the fixing roller is brought into contact with a toner, releasing agents are preferably incorporated into said toner to assure sufficient releasability.

However, in a toner which is prepared employing a conventional pulverization method, materials dispersed into toner particles exist non-uniformly on a broken surface. Particularly, materials such as releasing agents, which melt quickly in the narrow temperature range, tend to be concentrated on the surface so that surface properties among toner particles tend to be non-uniform. Due to that, it becomes difficult to stabilize the developed amount as well as to assure uniform adhesion among the toner particles of each color. As a result, problems occur in which fluctuation tends to result and color reproduction properties, required for quality color images, are degraded.

On the other hand, a so-called polymerization toner has been known which is prepared utilizing a polymerization method. Of said polymerization toners, a toner prepared by utilizing a suspension polymerization method is comprised of spherical toner particles with uniform surface properties. Thus, it is supposed that uniformity among toner particles is enhanced. However, the particle shape tends to become spherical and adhesion onto an electrostatic latent image bearing body as well as onto an image support is enhanced. As a result, problems tend to occur in which transferability is degraded and image repellency during fixing occurs.

As a result, by employing the image forming method comprised of said tandem method, at present, it is difficult to obtain consistent image quality over an extended period of time.

Known as a color image forming method has been a method utilizing a so-called intermediate transfer system in which a latent image formed on a latent image bearing body is developed employing a toner; instead of transferring the resulting toner image directly onto an image forming support, it is temporarily transferred onto an intermediate transfer body, and subsequently retransferred onto said image forming support.

In said intermediate transfer method, by transferring a toner image formed on a latent image bearing body onto an intermediate transfer body several times (for example, 4 times), each color toner layer is laminated on said intermediate transfer body (color layering). In this case, when the last color toner image is transferred onto the intermediate transfer body, the charge amount of the toner, constituting the color toner image which has been first transferred onto said intermediate transfer body, decreases occasionally. In order to minimize the decrease in the charge amount of the toner image in the lower layer, it is required to employ a toner with stable chargeability.

On the other hand, widely employed as a means to fix toner images formed on an image forming support, is a heating roller system, employing a fixing unit provided with a heating roller as well as with a pressure roller.

In said system, a toner is brought into contact with the surface of said heating roller. As a result, so-called offset phenomena tend to occur. Herein, in order to minimize said offset phenomena, a method is employed in which a relatively large amount of silicone oil is applied to the surface of said heating roller so as to provide releasability.

However, when a relatively large amount of silicone oil is employed, problems occur in which silicone oil adheres onto an image forming support and the mechanism of the fixing unit itself becomes more complex. Accordingly, it is desirous that releasability be provided in the toner itself so that the coating amount of silicone oil required for the fixing unit itself can be reduced, or silicone oil is not at all necessary.

In the intermediate transfer system as previously described, when a toner produced employing a pulverization method is utilized, materials dispersed into toner raw materials exist non-uniformly on a broken surface. As a result, it becomes difficult to make the surface properties among toner particle uniform. As a result, problems occur in which transferability tends to fluctuate, and accordingly, color reproduction properties required for quality color images are degraded.

Further, when a toner, produced employing a suspension polymerization, is utilized, an advantage is obtained in which stable transferability is obtained due to uniform surface properties among toner particles.

However, in said suspension polymerization, it is extremely difficult to place releasing agents on the surface of toner particles. As a result, the fixability (particularly, releasability) of toner particles is limited to employed resins, that is, approaches the properties of said resins. Subsequently, problems occur in which offset phenomena occur due to insufficient releasability of toner particles, and image staining results due to the resulting offset phenomena.

As a means to overcome such problems, for example, Japanese Patent Publication Open to Public Inspection No. 10-97098 proposes a suspension polymerization toner which incorporates a large amount of releasing agents in the interior of the toner particles.

However, in such a suspension polymerization toner, since a large amount of releasing agent is incorporated in the interior of toner particles, problems occur in which, due to a decrease in light transmittance caused by the domain of releasing agents, the smoothness of the color image after the fixing process is degraded, resulting in color contamination, and the color reproduction range, which is obtained employing a plurality of colors, is narrowed.

When color images are formed employing the intermediate transfer system as previously described, means have not yet been known which simultaneously result in sufficient color reproduction properties (smoothness of each color toner layer) and fixability (releasability). As a result, it has been difficult to form consistently quality color images.

SUMMARY OF THE INVENTION

An object of the present invention is to provide a toner capable of forming color images which exhibit excellent fixability and offsetting resistance, as well as excellent color reproduction, even when employed in an image forming method comprising a fixed color image forming process employing a fixing unit to which no silicone oil, or a very small amount of silicone oil is supplied.

Another object of the present invention is to provide an image forming method capable of forming no offset phenomena, increasing the fixing ratio, and exhibiting excellent color reproduction properties, while employing an image forming method comprising a fixed color image forming process, employing a fixing unit to which no silicone oil, or a very small amount of silicone oil is supplied.

The other object of the present invention is to provide a color image forming method and an image forming apparatus which results in excellent and consistent color reproduction properties over an extended period of time, and an electrostatic latent image developing toner employed in them.

An object of the present invention is to provide a toner capable of forming color images with excellent offsetting resistance as well as excellent color reproduction properties in the wide range for an extended period of time, in the case of forming color images employing an intermediate transfer system, even when said toner is employed in an image forming method comprising a fixed color image forming process, employing a fixing unit to which no silicone oil or only a very small silicone oil is supplied.

Another object of the present invention is to provide an image forming method capable of forming no offset phenomena as well as forming color images with excellent color reproduction properties for an extended period of time in the case of forming color images, even when there is included a fixed color forming process, employing a fixing unit to which no silicone oil or only a very small silicone oil is supplied.

Said fixing unit is employed in an image forming method in which a toner image formed on said photoreceptor is transferred onto an image forming support, and the transferred toner image is fixed employing a fixing unit. Said fixing unit is comprised of a heating roller and a pressure roller which is brought into contact with said heating roller. Said heating roller is constituted in such a manner that the surface of a cylinder having an interior diameter of from 10 to 70 mm and a wall thickness of from 0.1 to 2 mm, comprised of a metal or a metal alloy, is covered with an elastic martial having an Asker hardness C of less than 70 degrees at a thickness of from 0.1 to 30 mm, and a heating member is incorporated in its interior. Said pressure roller is constituted in such a manner that the surface of a metal cylinder is covered with an elastic material having an Asker hardness C of less than 80 degrees at a thickness of from 0.1 to 30 mm.

The supplied amount of silicone oil to said heating roller, comprised of said fixing unit, is preferably not more than 2 mg/A4 sized sheet of paper.

In a toner which is employed in an image forming process which is comprised of a process in which a latent image is formed on a latent image bearing body, a process in which said latent image is developed employing a developer comprising said toner, a process in which a toner image formed on said latent image bearing body is transferred onto an intermediate transfer body, a process in which the toner image formed on said intermediate transfer body is transferred onto an image forming support, and a process in which the toner image transferred onto said image forming support is fixed employing a fixing unit which utilizes a heating roller fixing system, a toner of the present invention is obtained by salting out/fusing resinous particles comprising at least a binding resin containing a releasing agents, a colorant, and a releasing agent, and colorant particles.

"Salting-out/fusion", as described in the present invention, refers to an operation in which salting-out (aggregation of particles) and fusion (disappearance of the interface between particles) occur simultaneously, or salting-out and fusion are allowed to occur simultaneously. In order to simultaneously carry out salting-out and fusion, it is required that particles (resinous particles and colorant particles) are aggregated at a temperature which is equal to or higher than the glass transition temperature (Tg) of the resin constituting said particles.

The inventors of the present invention have investigated the composition of toners which are required to effectively minimize offset phenomena during fixing. As a result, it was discovered that it was possible to effectively minimize the offset phenomena by employing a coalesced type toner which was obtained by salting out/fusing resinous particles comprising releasing agents, together with colorant particles in a water based medium.

Generally, the toner, into which releasing agents are incorporated, results in a decrease in light transmittance due to the domain of said releasing agents. Therefore, it has been considered that it is impossible to use releasing agents in a color image forming toner. However, in the present invention, it is possible to minimize the color contamination of color images, as well as to enhance transparency, by incorporating releasing agents which require said domain structure and employing a method which salts out/fuses said resinous particles. As a result, it has become possible to improve color reproduction properties of fixed color images.

Further, the following has been discovered. The surface of a heating roller as well as a pressure roller in a fixing unit is formed employing an elastic material so that the nip width is widened. As a result, it is possible to maintain the fused state of a toner during fixing and to readily form a toner layer on the smoothed interface so that it is possible to enhance the color reproduction properties.

However, when such a constitution of a fixing unit is only employed, the nip width during fixing is widened, while a peeling angle in the fix peeling section increases so as to result in a state in which offset phenomena tend to occur.

Therefore, it is possible to exhibit the effects of the present invention by combining said fixing unit with a specified coalesced toner (the toner of the present invention), instead of employing only said fixing unit.

(1) Since the toner of the present invention is a coalesced type toner prepared employing a salting-out/fusion method, the surface properties among toner particles is uniform. As a result, it is possible to achieve excellent fixability (2) Since the toner of the present invention is comprised of toner particles, having releasing agents (which have been incorporated into resinous particles) on its surface, it is possible to achieve excellent offsetting resistance.

(3) Since the toner of the present invention is obtained by coalescing resinous particles containing releasing agents, employing said salting-out fusion method, color contamination problems which result in the simple addition of said releasing agents do not occur, and high light transmittance is achieved. As a result, it is possible to form fixed color images which exhibit excellent color reproduction properties.

(4) Since each of the heating roller and the pressure roller, which constitute a fixing unit, is covered with an elastic material having low hardness, the resulting nip width is widened, making it possible to form a smoothed toner layer at the interface. As a result, it is possible to improve the color reproduction as well as to enlarge the color reproduction range.

(5) As previously described, by combining the specified coalesced type toner with the specified fixing unit, it is possible to simultaneously achieve excellent offsetting resistance as well as excellent color reproduction of fixed images.

DETAILED DESCRIPTION OF THE INVENTION

Fixing Unit

The toner of the present invention is employed in an image forming method (the image forming method of the present invention) comprising a fixing process employing a specified fixing unit.

Figure 1:
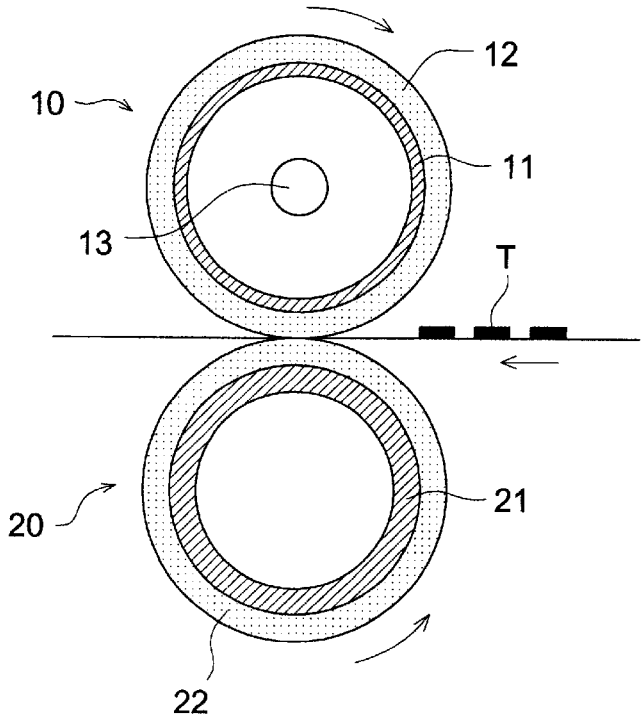
FIG. 1 is a cross-sectional view showing an example of a fixing unit employed in the present invention.

FIG. 1 is a cross-sectional view showing an example of a fixing unit employed in the present invention. The fixing unit shown in FIG. 1 comprises heating roller 10 and pressure roller 20 which is brought into contact with said heating roller 10. Further, in FIG. 1, T is a toner image formed on a sheet of transfer paper (an image forming support).

Heating roller 10 comprises cylinder 11 having thereon covering layer 12 comprised of an elastic material and includes heating member 13 comprised of a linear heater.

Said cylinder 11 is comprised of metal and its interior diameter is from 10 to 70 mm. Metals which constitute cylinder 11 are not particularly limited, and include, for example, metals such as iron, aluminum, copper, and the like, and alloys thereof.

The wall thickness of cylinder 11 is from 0.1 to 2 mm, and is determined while taking into account the balance between the demand of energy saving (by a decrease in thickness) and strength (dependent on the composition materials). For example, the some strength resulting from an iron cylinder having a wall thickness of 0.57 mm is obtained by an aluminum cylinder having a wall thickness of 0.8 mm.

Preferably employed as elastic materials which constitute said covering layer 12 are silicone rubber as well as fluorine rubber such as LTV, RTV, HTV, and the like which exhibit excellent heat resistance, and silicone foamed rubber.

The Asker C hardness of elastic materials, constituting covering layer 12, is commonly less than 70 degrees, and is preferably less than 60 degrees.

Further, the thickness of covering layer 12 is commonly from 0.1 to 30 mm, and is preferably from 0.1 to 20 mm.

When the Asker C hardness of elastic materials constituting covering layer 12 exceeds 70 degrees, as well as when the thickness of the covering layer 12 is less than 0.1 mm, it is impossible to increase the fixing nip. Accordingly it is impossible to exhibit effects of soft fixing (color reproduction enhancing effects due to the toner layer at the smoothed interface).

Asker C hardness is determined in accordance with JIS K6253-1997 or ISO7619, and is measured on a rubber sample having thickness of 12 mm by employing Type A durometer.

Halogen heaters may be suitably employed as heating member 13.

Pressure roller 20 comprises cylinder 21 having on its surface covering layer 22 comprised of elastic materials. Elastic materials constituting covering layer 22 are not particularly limited, and may include various types of soft rubber such as urethane rubber, silicone rubber, and the like, and also foamed rubber. Fluorine rubber, silicone rubber, and silicone foamed rubber are preferably employed, which are exemplified as those constituting covering layer 12.

The Asker C hardness of elastic materials, constituting covering layer 22 of the pressure roller, is commonly less than 70 degrees, and is preferably less than 60 degrees.

Further, the thickness of covering layer 22 is commonly from 0.1 to 30 mm, and is preferably from 0.1 to 20 mm.

When the Asker C hardness of elastic materials constituting covering layer 22 exceeds 70 degrees, as well as when the thickness of the covering layer 22 is less than 0.1 mm, it is impossible to increase the fixing nip. Accordingly it is impossible to exhibit effects of soft fixing.

Materials constituting cylinder 21 are not particularly limited, and may include metals such as aluminum, iron, copper, and the like, and alloys thereof.

The contact load (total load) of heating roller 10 applied to pressure roller 20 is commonly from 40 to 350 N, is preferably from 50 to 300 N, and is more preferably from 50 to 250 N. Said load is set taking into the strength (the wall thickness of cylinder 11) of heating roller 10. For example, when a heating roller comprised of an iron cylinder having a wall thickness of 0.3 mm is employed, the applied load is preferably not more than 250 N.

Further, from the viewpoint of offsetting resistance as well as fixability, nip width is preferably from 3 to 10 mm, and the surface pressure of said nip is preferably from $0.6\times10^5$ to $1.5\times10^5$ Pa.

When the fixing unit shown in FIG. 1 is employed, an example of fixing conditions are as follows: fixing temperature (surface temperature of heating roller 10) is from 150 to 210° C., and fixing linear speed is from 80 to 640 mm/second.

If desired, the fixing unit employed in the present invention may have a cleaning mechanism. In this case, when a method is employed in which silicone oil is supplied to the upper roller (a heating roller) in the fixing section, it is possible to employ a method in which cleaning is carried out by supplying silicone oil employing a silicone oil impregnated pad, a roller, a web, and the like.

Employed as silicone oils are those which exhibit high heat resistance and include polydimethylsilicone, polyphenylsilicone, polydiphenylsilicone, and the like. Silicone oils having low viscosity result in increase in a flow amount during use. Therefore, those having a viscosity of from 1 to 100 Pa·s are preferably used.

However, the effects of the present invention are markedly exhibited when an image forming process is included by employing a fixing unit in which no silicone oil is supplied, or when only a very small amount of silicone oil is supplied. Accordingly, even when silicone oil is supplied, the supply amount is preferably not more than 2 mg per A4 sized sheet of paper.

By regulating the supply amount of silicone oil to not more than 2 mg per A4 sized sheet of paper, the adhesion amount of silicone oil to a transfer sheet (an image forming support), after fixing, decreases. As a result, adhered silicone oil does not hinder writing on the transfer sheet using writing materials comprising oil based ink such as a ballpoint pen and the like, and thus writability, in general, is not degraded.

Herein, the supply amount of the silicone oil is calculated as follows: 100 transfer sheets (A4 sized sheets without images) are continually passed through a heated fixing unit (between rollers), the weight difference ($\Delta w$) of the fixing unit before and after passing said sheets is determined, and is then calculated (as $\Delta w/100$).

Image Forming Method and Image Forming Apparatus

In the present invention, as image forming apparatuses employed may be common presses, copiers, and printers. Herein, as one example, an image forming apparatus employing an electrophotographic system shown in FIG. 2 will be described.

Figure 2:
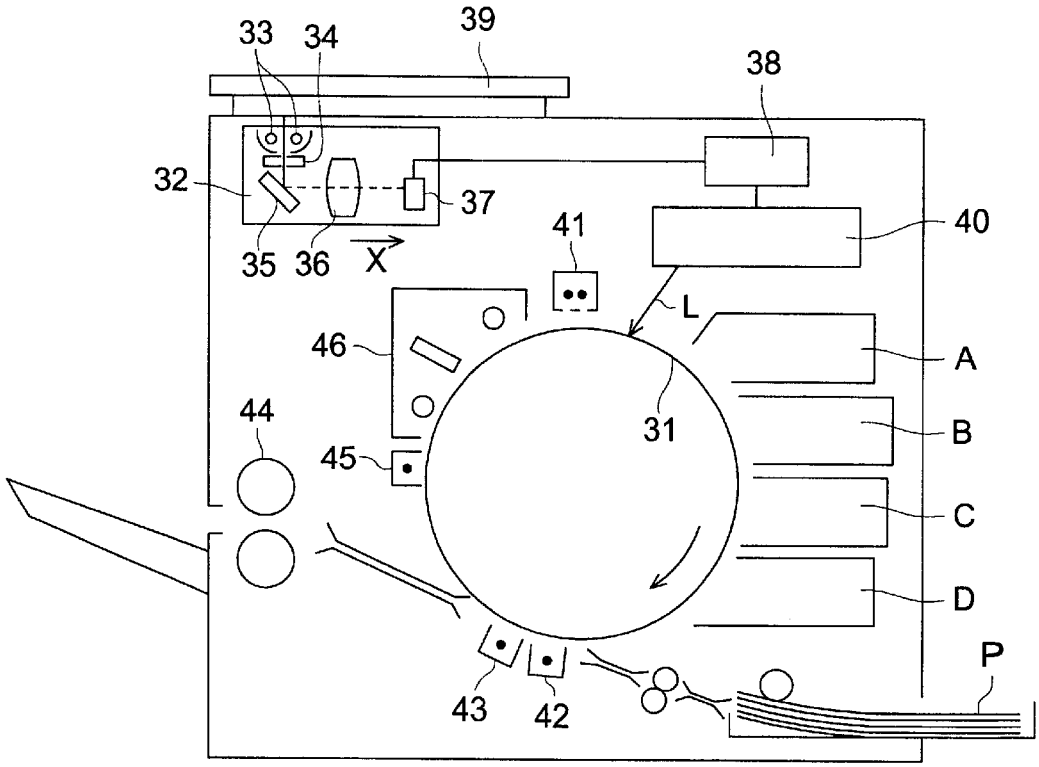
FIG. 2 is a schematic view of an image forming apparatus for use in the image forming method of the present invention.

In FIG. 2, numeral 31 is an image forming body comprised of a negatively chargeable OPC photoreceptor comprising a carrier transport layer as the upper layer, and rotates in the arrowed direction. Numeral 32 is an image inputting section. Said image inputting section 32 is comprised of illumination light source 33, color separation filter 34, for example, comprised of blue, green, red, and ND filters, each of which are changeable, reflection mirror 35, lens 36, and linear CCD image sensor 37. Numeral 38 is an image processing section, comprising an inverter which converts color separation information to complementary color information, numeral 39 is a multicolor original document, L is a laser beam emitted from laser optical system 40, numeral 41 is charging unit for negative charging comprised of scorotron charging electrodes. Numeral 42 is a corona discharging unit for transfer, numeral 43 is a separation electrode, numeral 44 is a fixing unit (a fixing unit constituted as shown in FIG. 1), numeral 45 is a charge eliminating unit prior to cleaning, and numeral 46 is a cleaning unit. Further, A, B, C, and D are development units in which each of yellow, magenta, cyan, and black developers is placed.

Reflected light inputted from image inputting section 32 is subjected to color separation, employing color separation filter 34 and color separation information is read by CCD image sensor 37, and converted to electrical signals. At the first rotation of image forming body 31, among said image data, for example, laser beam L in accordance with recorded data of yellow component is irradiated by laser optical system onto image forming body 31 of which surface is uniformly and negatively charged by charging unit 41 for negative charging, and an electrostatic latent image corresponding to said recorded data is formed on said image forming body 31.

The resulting electrostatic latent image is developed employing development unit A in which said yellow toner is placed. In the same manner, magenta, cyan, and black toner images are superimposed and a color toner image comprised of four basic colors is formed. The color image obtained as above is transferred onto image forming support P, employing transfer corona discharge electrode 42; subsequently, separated from said image forming body employing separation electrode 43; and fixed employing fixing unit 44, whereby a color image is formed.

On the other hand, after the transfer of a color toner image, image forming body 31 is subjected to charge elimination employing charge eliminator prior to cleaning 45, subsequently is cleaned, and prepared for the following color image formation.

The other image forming method and apparatus, to which the invention can be applied, of a so-called tandem system is described.

Figure 3:
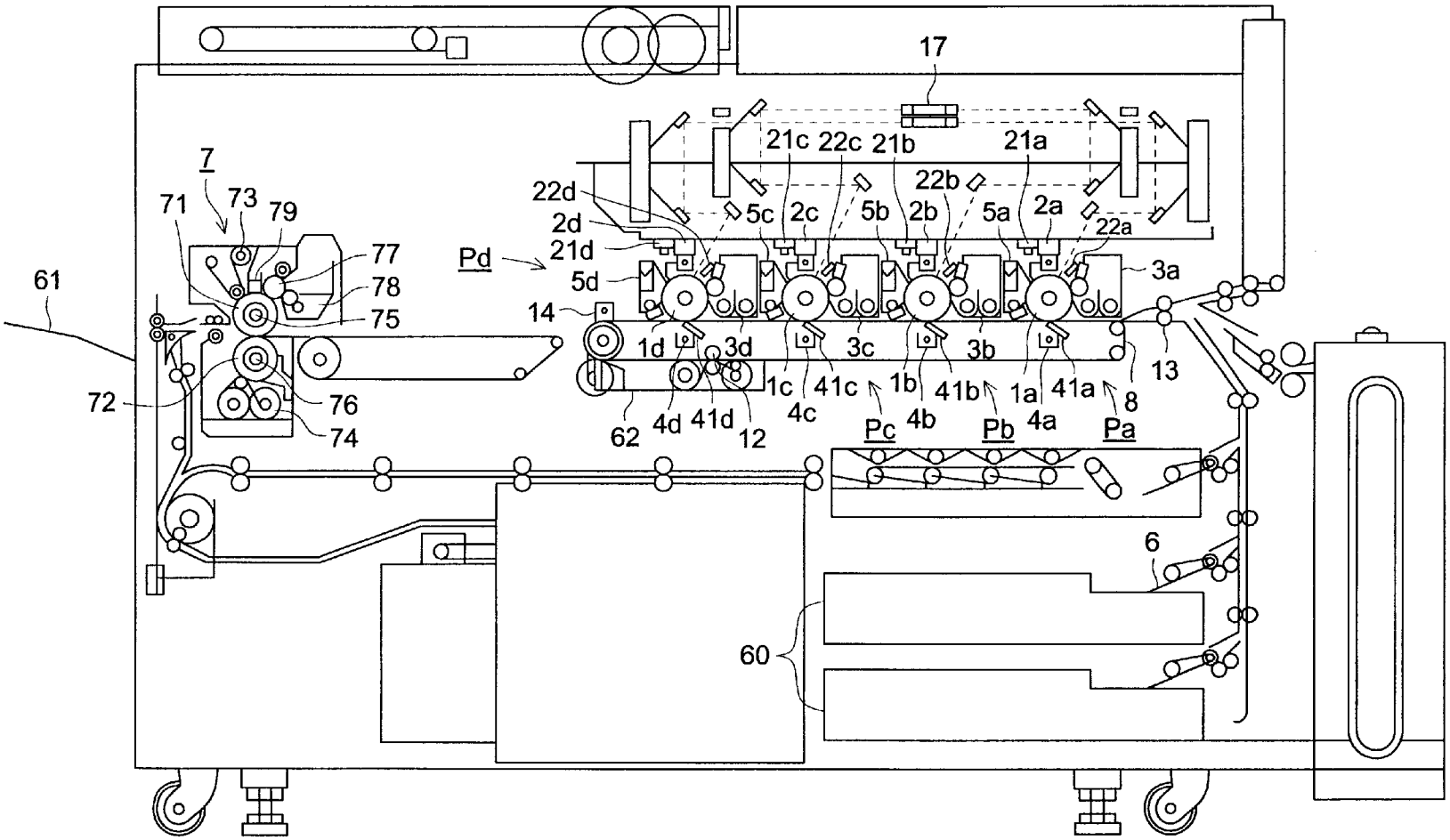
FIG. 3 is a schematic view showing another example of the color electrophotographic image forming apparatus of the present invention.

FIG. 3 is a schematic view showing another example of the color electrophotographic image forming apparatus of the present invention.

In the main body of a color electrophotographic image forming apparatus, first image forming section Pa, second image forming section Pb, third image forming section Pc, and fourth image forming section Pd are arranged in a line. All these image forming sections are equally constituted, and each section forms a visible image (a toner image) with different color.

Each of image forming sections Pa, Pb, Pc, and Pd is equipped with special electrostatic latent image bearing bodies (electrophotographic photosensitive drums) 1*a*, 1*b*, 1*c*, and 1*d*. An image on each of electrophotographic photoreceptor drums (hereinafter referred occasionally to as a photoreceptor drum) 1*a*, 1*b*, 1*c*, and 1*d*, which is formed in each of image forming sections Pa, Pb, Pc, and Pd is transferred onto image support 6 which is conveyed while being held on image support bearing body 8 which moves adjacent to each image forming section. Further, the image on image support 6 is heated and pressed at fixing section 7 and fixed. The resulting image support is ejected to tray 61.

A latent image forming section in each of said image forming sections will now be described. In the external circumference of each of photoreceptor drums 1*a*, 1*b*, 1*c*, and 1*d*, provided are each of charge eliminating exposure lamps 21*a*, 21*b*, 21*c*, and 21*d*, each of drum charging units 2*a*, 2*b*, 2*c*, and 2*d*, laser beam exposure unit 17 as the image exposure means, and each of electric potential sensors 22*a*, 22*b*, 22*c*, and 22*d*. Photoreceptor drums 1*a*, 1*b*, 1*c*, and 1*d* which have been subjected to charge elimination employing charge eliminating exposure lamps 21*a*, 21*b*, 21*c*, and 22*d* are uniformly charged employing drum charging units 2*a*, 2*b*, 2*c*, and 2*d*, and subsequently exposed employing laser beam exposure unit 17, whereby on photoreceptor drums 1*a*, 1*b*, 1*c*, and 1*d*, electrostatic latent images which are subjected to color separation in accordance with image signals are formed. As image exposure means, in addition to said leaser beam exposure unit 15, well known multi-level exposure means such as an LED array exposure unit, in which in a basic image unit (pixel), a light amount level besides off makes it possible to irradiate a plurality of light spots, may be suitably applied to the image forming apparatus of the present invention.

Electrostatic latent images on said photoreceptor drums are developed by development means to form visible images. Namely, said development means are comprised of development units 3*a*, 3*b*, 3*c*, and 3*d* in which each of cyan, magenta, yellow, and black developers, for example a two-component developer comprised of a toner and a carrier, is placed in a specified amount, and develop electrostatic latent images formed on said photoreceptor drums 1*a*, 1*b*, 1*c*, and 1*d* to form visible images (toner images).

Subsequently, the transfer section will now be described. Image support 6 held in image support cassette 60 is conveyed to image support bearing body 8 via register roller 13.

Herein, said image support bearing body 8 is a dielectric resinous film sheet such as a polyethylene terephthalate resinous film sheet (PET sheet), a polyfluorinated vinylidene resinous film, a polyurethane resinous film sheet, and the like, in which both ends are overlapped and connected so as to form an endless shape. Alternatively, a belt having no joint (seamless) is employed. When a belt having joints is employed, it is preferable that a means (not shown) to detect joints is provided so that no transfer is carried out on any joint.

When said image support bearing body 8 starts rotating, image support 6 is conveyed to image support bearing body 8 from register roller 13. At the same time, an image writing signal turns ON, and an image is formed on first electrophotographic photoreceptor drum 1*a* under appropriate timing.

Below said first electrophotographic photoreceptor drum 1*a*, transfer charging unit 4*a* and transfer pressing member 41*a* are provided, and the toner image on photoreceptor drum 1*a* is transferred onto image support 6 in such a manner that uniform force is applied to said photoreceptor drum employing transfer pressing member 41*a* and an electric field is applied employing said transfer charging unit 4*a*. At that time, image support 6 is held on image support bearing body 8, employing an electrostatic adhesive force, and said image support 6 is conveyed to second image forming section Pb so that the subsequent transfer is carried out. Image support 6, onto which toner images, which have been formed employing third and fourth image forming sections Pc and Pd in the same manner as above, are transferred, is subjected to charge elimination utilizing separation charging unit 14; separated from said support bearing body 8 utilizing a decrease in the electrostatic adhesive force; and conveyed to fixing section 7.

Fixing section 7 comprises fixing roller 71, pressure roller 72, heat resistant cleaning members 73 and 74 which clean each of said rollers 71 and 72, heating rollers 75 and 76 which heat each of said rollers 71 and 72, oil applying roller 77 which applies releasing oils such as dimethyl silicone and the like to said fixing roller 71, oil storage tank 78 which supplies said oils, and fixing temperature controlling thermistor 79.

After transfer, toner and the like which remain on photoreceptor drums 1*a*, 1*b*, 1*c*, and 1*d* are removed by photoreceptor cleaning sections 5*a*, 5*b*, 5*c*, and 5*d*, so that said photoreceptors are ready for the subsequent latent image formation. Further, toner and the like which remains on image support 8 are subjected to charge elimination utilizing belt charge elimination unit 12; subjected to removal of an electrostatic adhesive force; and removed employing cleaning unit 62 provided with nonwoven fabric in the present example. Employed as cleaning unit 62 are fur brushes, blades, these combining units, and the like.

Development means, which may be applied to the image forming apparatus of the present invention, will now be detailed with reference to FIG. 4. Since development means in image forming sections Pa, Pb, Pc, and Pd are constituted in the same manner, only development means in image forming section Pa will be described.

Figure 4:
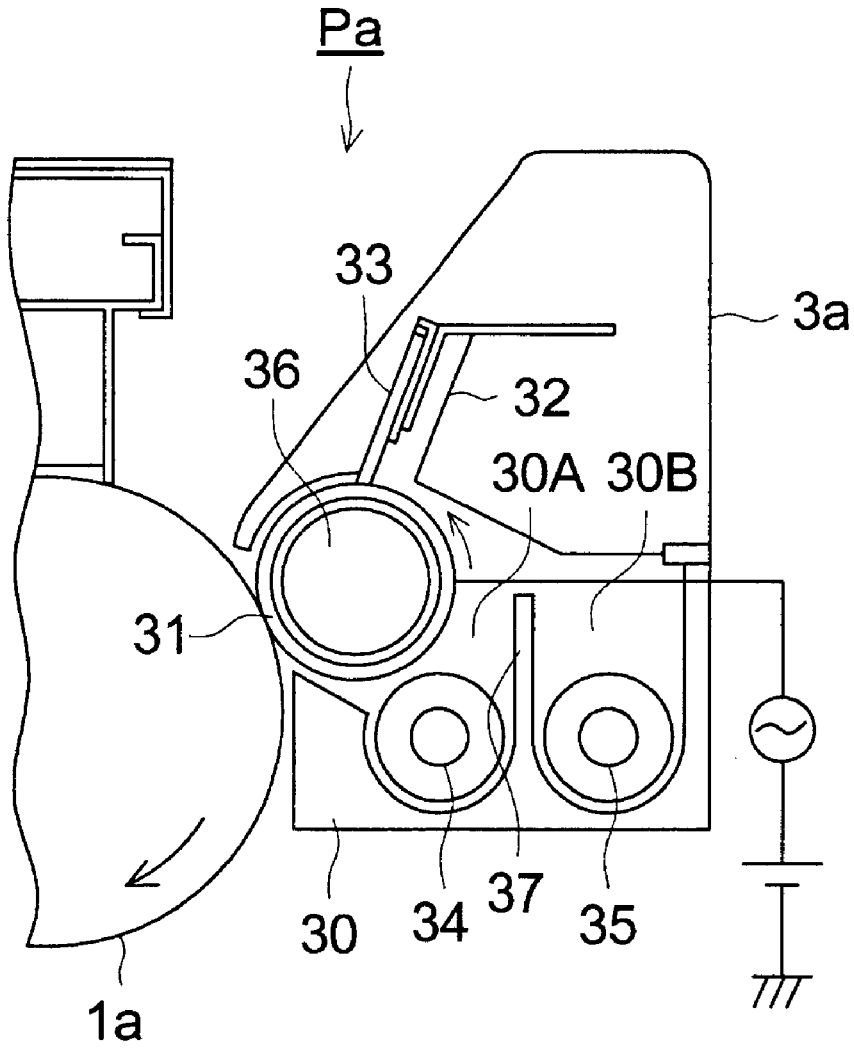
FIG. 4 is a schematic cross-sectional view of a development means in image forming section Pa of FIG. 3.

FIG. 4 is a schematic cross-sectional view of a development means (development unit or development apparatus) in image forming section Pa. Development unit 3*a*, which is arranged facing photoreceptor drum 1*a*, comprises developer vessel 30 in which a two-component developer is placed, development sleeve 31 as the developer bearing body, developer turning member 32 (developer staying amount regulating member on development sleeve 31), and blade 33 as developer thickness regulating member, and in addition, an optical toner concentration sensor (not shown) as the developer concentration detection means which measures the toner concentration of said two-component developer.

The interior of said developer vessel 30 is divided into developer chamber 30A and stirring chamber 30B, utilizing wall 37 extended nearly in the vertical direction. A two-component developer comprised of a non-magnetic toner and a magnetic carrier is placed in development chamber 30A and stirring chamber 30B. The upper part of wall 37 is released and excessive two-component developer in development chamber 30A is recovered in the side of stirring chamber 30. First and second screw type developer stirring and conveying means 34 and 35 are provided in each of said development chamber 30A and stirring chamber 30B. Said first stirring and conveying means 34 stirs and conveys the developer in development chamber 30A, while second stirring and conveying means 35 stirs and conveys under the control of the developer concentration control unit the toner supplied to the upper stream side of said stirring and conveying means 35 from the toner supply tank (not shown) and the developer which has been placed in stirring chamber 30B so that the toner concentration becomes uniform. At the front side edge and the rear side edge of said wall 37, developer paths (not shown) which pass between development chamber 30A and stirring chamber 30B are formed, and the developer in development chamber 30A, in which the toner concentration decreases due to the consumption of the toner through development, is moved to stirring chamber 30A through one of said paths employing the conveying force of said stirring and conveying means.

Said development chamber 30A possesses an aperture at the position corresponding to the development region facing photoreceptor drum 3*a*, and said sleeve 31 is rotatably arranged so that said sleeve 31 is partly exposed to said aperture. Development sleeve 31 is comprised of non-magnetic materials and rotates in the arrowed direction during development operation. In its interior, magnet 36, which is a magnetic filed generating means, is fixed.

The two-component developer supplied onto the surface of development sleeve 31, utilizing said stirring and conveying means is held in a magnetic brush by the magnetic force of magnet 36 and conveyed to the development zone facing photoreceptor drum 1*a* along with the rotation of development sleeve 31. During the conveyance, the height of said magnetic brush on development sleeve 31 is adjusted employing developer turning member 32 and blade 33, and the developer conveyed to the development zone is maintained in an appropriate amount.

The developer conveyed to the development zone utilizing development sleeve 31, as previously described, is supplied onto photoreceptor drum 3*a* and develops an electrostatic latent image formed thereon. In order to enhance development efficiency, e.g. a toner providing ratio to a latent image, development bias voltage which is subjected to superposition of direct current voltage and alternative current voltage from power source, or either one of development bias voltage is applied to development sleeve 31. By such voltage application, the toner of said two-component developer is transferred onto an electrostatic latent image on photoreceptor drum 1*a* so that said electrostatic latent image is visualized as the toner image.

Incidentally, the aforementioned transfer of toner images is described based on the system in which each of color toner images is transferred onto an image support (generally, plain paper, and the like, and called a transfer paper since sheets of paper are used) which is conveyed while being placed on an image support bearing body. However, instead of the image support bearing body, an intermediate transfer body may be employed, and after a toner image is temporality transferred onto said intermediate transfer body, said toner image may be retransferred onto an image support. Further, commonly employed as image support bearing bodies as well as intermediate bodies are those in a belt shape or a drum shape.

Further, when a very long photoreceptor is employed, one photoreceptor may perform all necessary operations without employing a plurality of photoreceptors.

Figure 6:
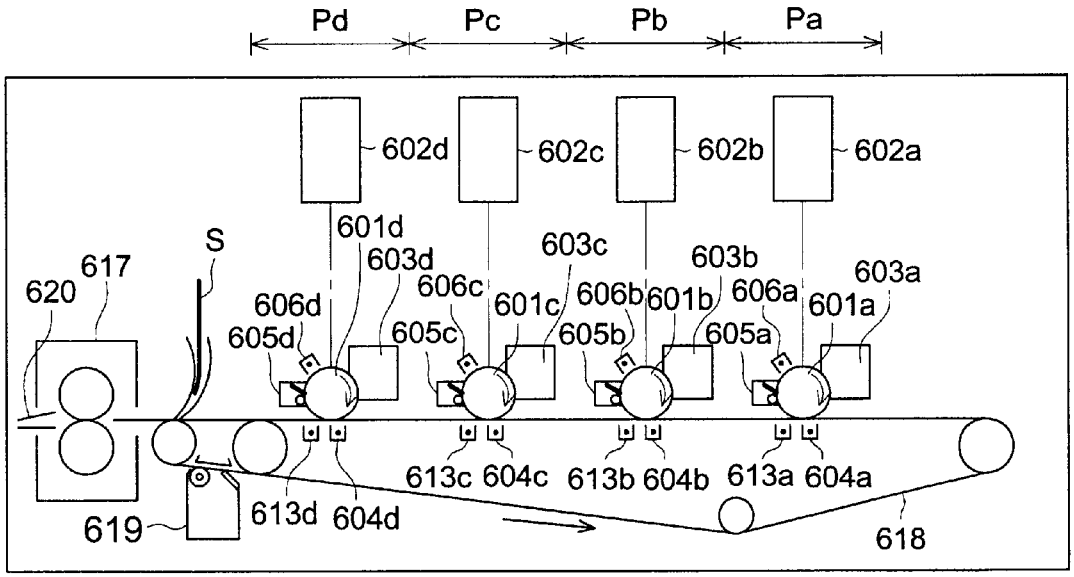
FIG. 6 is a schematic view showing another example of the color electrophotographic image forming apparatus.

FIG. 6 is a schematic view showing another example of the color electrophotographic image forming apparatus similar to one shown in FIG. 3 used for the present invention.

Figure 5:
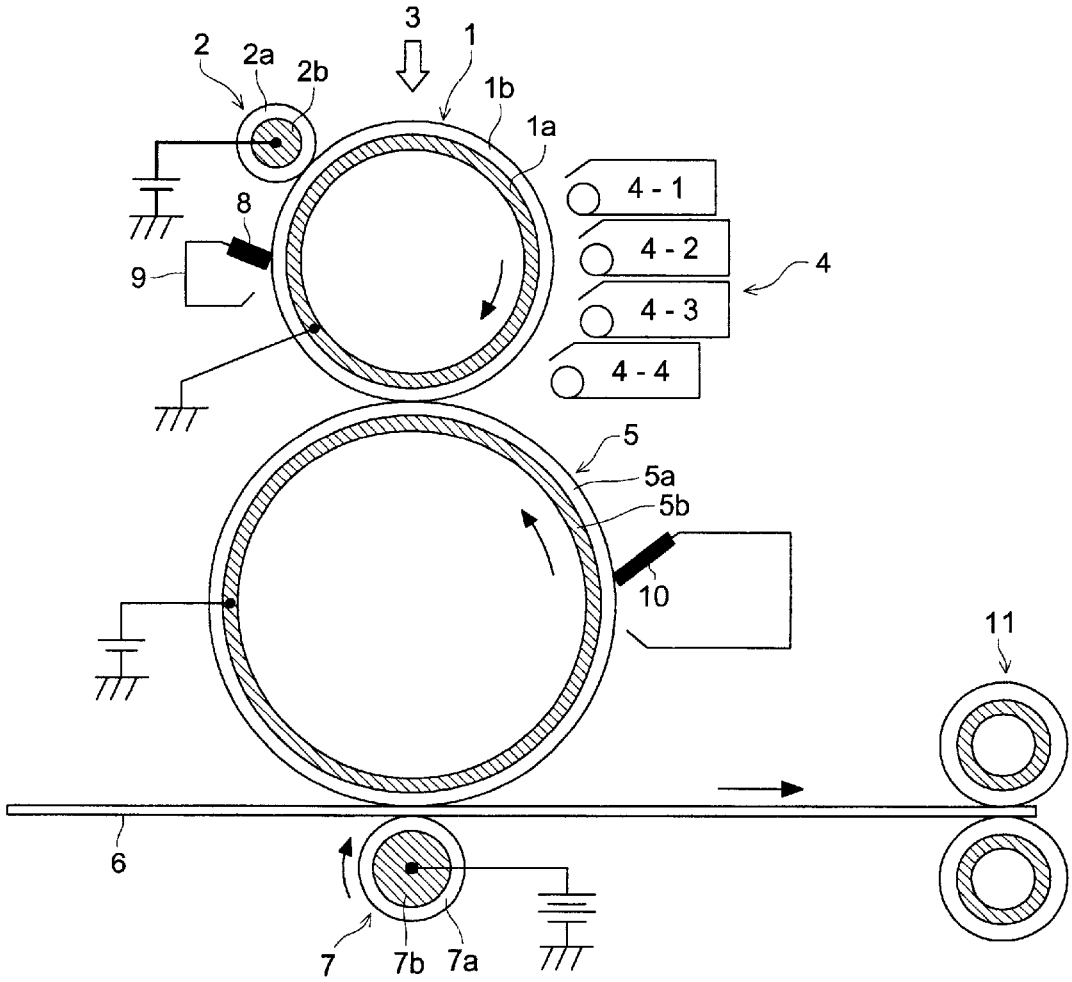
FIG. 5 is a schematic view of another image forming apparatus.

FIG. 5 is a schematic view of another image forming apparatus for use in the image forming method of the present invention. In FIG. 5, each of a developer comprising a cyan toner, a developer comprising a magenta toner, a developer comprising a yellow toner, and a developer comprising a black toner is placed in each of developments units 4-1, 4-2, 4-3, and 4-4, and a latent image formed on latent image bearing body 1 is developed using a magnetic bush development system, non-magnetic one-component development method, or the like whereby each color toner image is formed on latent image bearing body 1. Herein, said latent image is formed in such a manner that, for example, exposure 3 is carried out onto latent image bearing body 1 in accordance with digital image information, employing a polygonal mirror and the like.

Image bearing body 1 is either a photosensitive drum or a photosensitive belt comprising a photoconductive insulating material layer. Said image bearing body 1 rotates in the arrowed direction, employing a driving unit (not shown).

A organic photosensitive layer may be either a single layer comprising change generating materials and charge transport materials in the same layer, or a function separated type photosensitive layer comprised of a charge transport layer and a charge generating layer. One preferred example is a laminated type photosensitive layer having a structure in which onto an electrically conductive support, a charge generating layer is applied and thereon a charge transport layer is laminated.

From the view that an organic photosensitive layer exhibits excellent transferability as well as excellent cleaning properties, it is particularly preferable that said layer is comprised of polycarbonate resins, polyester resins, and acryl based resins. By realizing the above, cleaning problems, toner fusion onto a photoreceptor, and filming of external additives tend not to occur.

In the charging process of the present invention, there are a non-contact system in which latent image bearing body 1, using a corona discharge unit, has no contact, and a contact system using rollers and the like, and either system may be employed. However, in order to conduct efficient uniform charging, simplification, and a decrease in ozone generation, the contact system as shown in FIG. 5 is preferably employed.

Charging roller 2 is basically comprised of a metal cylinder 2*b* as the core and an electrically conductive elastic layer 2*a* forming the outer circumference. Charging roller 2 is brought into pressure contact with the surface of latent image bearing body under application of pressing force and rotates along with the rotation of photoreceptor 1.

When said charging roller is employed, preferred process conditions are as follows: a contact pressure of said roller of from 5 to 500 g/cm, upon using superimposition of direct current voltage and alternative current voltage, a current voltage of from 0.5 to 5 kVpp, and an alternative current frequency of from 50 Hz to 5 kHz, a direct current voltage of from ±0.3 to ±1.5 kV, and upon using direct current voltage, a direct current voltage of from ±0.2 to ±5 kV.

Other charging means include a method utilizing a charging blade, and a method utilizing an electrically conductive brush. These contact charging means exhibit effects such as no requirement of high voltage, a decrease in ozone generation, and the like.

Electrically conductive rubber is preferably utilized as materials of said charging roller as well as said charging blade employed as contact charging means and on its surface, a releasable film may be formed. Nylon based resins, PVDF (polyfluorinated vinylidene), PVDC (polychlorinated vinylidene), and the like may be applied to form said releasing film.

A toner image formed on latent image bearing body 1 is transferred onto intermediate transfer body 5 to which voltage (for example, from ±0.1 to ±5 kV) is applied.

Herein, a toner which remains on said image bearing body 1 is recovered to residual toner vessel 9, employing cleaner member 8.

Intermediate transfer body 5 is comprised of a electrically conductive cylinder 5*b* and elastic material layer 5*a* with medium electric resisitivity, forming its circumferential surface. Said cylinder 5*b* may be prepared by applying electrically conductive plating to a plastic cylinder.

Elastic material layer 5*b* is either a solid or foamed layer prepared by dispersing electrical conductivity providing materials such as carbon black, zinc oxide, tin oxide, and silicon carbide into silicone rubber, Teflon rubber, chloroprene rubber, urethane rubber, EPDM (tertiary copolymer of ethylene-propylene-diene), and the like while adjusting the electric resisitivity (volume resisitivity) to the medium range of from 105 to 1011 Ω·cm.

Intermediate transfer body 5 is subjected to bearing in parallel to latent image bearing body 1 and is arranged so as to come into contact with the lower surface section of said latent image bearing body. It rotates anticlockwise in the arrowed direction at the same circumferential speed as said latent image bearing body 1.

When a first color toner image, which is formed on the surface of latent image bearing body 1, passes through a transfer nip section in which said latent image bearing body 1 is brought into contact with intermediate transfer body 5, intermediate transfer is carried out with respect to the exterior surface of said intermediate transfer body 5, utilizing an electric field formed in the nip zone by transfer bias applied to said intermediate transfer body 5.

After transferring a toner image onto an image forming support, if required, the surface of intermediate transfer body 5 is cleaned by a detachable cleaning means 10. When a toner image exists on intermediate transfer body 5, said cleaning means 10 is withdrawn from the surface of said intermediate transfer body 5 so that said toner image is not damaged.

A transfer means is subjected to bearing in parallel to intermediate transfer body 5 and arranged so as to come into contact with the lower surface section of said latent image bearing body 5. Said transfer means, for example, is transfer roller 7, and rotates clockwise in the arrowed direction at the same circumferential speed as said intermediate transfer body 5. Transfer roller 7 may be arrange so as to come into direct contact with said intermediate transfer body 5, or may be arranged so that a belt and the like come into contact with the space between said intermediate transfer body 5 and said transfer roller 7.

Transfer roller 7 is basically comprised of a metal cylinder 7*b* as the core and an electrically conductive elastic layer 7*a* forming the outer circumference.

It is possible to employ common materials to prepare intermediate transfer body 5 as well as transfer roller 7. In the present invention, by setting the volume resisitivity of elastic layer 7*a* of transfer roller 7 lower than that of elastic layer 5*a* of intermediate transfer body 5, it is possible to decrease voltage applied to transfer roller 7, and to form excellent toner images on a transfer sheet (image forming support) as well as to minimize winding tendency of transfer paper 6 to intermediate transfer body 5. It is particularly preferable that the volume resisitivity of elastic layer 5*a* of intermediate transfer body 5 is at least 10 times greater than that of elastic layer 7*a* of transfer roller 7.

The hardness of intermediate transfer body 5 as well as transfer roller 7 is measured based on JIS K-6301. Intermediate transfer body 5, employed in the present invention, is preferably comprised of elastic layer 5*a* which belongs to the hardness rang of from 10 to 40 degrees. On the other hand, in order to minimize winding tendency of transfer sheet 6 to intermediate transfer body 5, the hardness of elastic layer 7*a* of transfer roller 7 is preferably from 41 to 80 degrees which is greater than that of elastic layer 5*a* of intermediate transfer body 5. When the hardness of intermediate transfer body is smaller than that of transfer roller 7, a concave area is formed on transfer roller 7, and transfer paper 6 tends to wound intermediate transfer body 5.

Transfer roller 7 is rotated at a circumferential speed which is equal to or different from that of intermediate transfer body 5. Transfer paper 6 is conveyed between intermediate transfer body 5 and transfer roller 7. At the same time, the toner image on intermediate transfer body 5 is transferred onto the surface of transfer paper 6 by applying to transfer roller 7 bias having polarity opposite that of triboelectrical charge of the toner, employing a transfer bias means.

Employed as materials of transfer roller 7 may be the same as those employed in charging roller 2. Preferable transfer process conditions are as follows: contact pressure of said roller of from 5 to 500 g/cm, and a direct current voltage of from ±0.2 to ±10 kV.

For example, electrically conductive elastic layer 7*a* of transfer roller 7 is prepared by employing elastic materials having a volume resisitivity of from $10^6$ to $10^{10}$ Ω·cm such as polyurethane into which electrically conductive materials such as carbon black and the like are dispersed, ethylene-propylene-dine based tertiary copolymer (EPDM), and the like. Bias is applied to cylinder 7*a*, employing a constant voltage power source. Bias conditions are preferably in the range of from ±0.2 to ±10 kV.

Subsequently, transfer paper 6, as described below, is conveyed to fixing unit 11 which is basically comprised of a heating roller having a built-in heat emitting body such as a halogen heater and the like, and a pressure roller comprised of elastic materials which is brought into pressure contact with said heating roller under application of pressing force, and a toner image is heat-press-fixed onto transfer paper 6 by passing between said heating roller and said pressure roller. A fixing method may be employed in which fixing is carried out employing a heater via film.

Toner

In the present invention, preferably employed is a toner which comprises binding resins, colorants, and releasing agents, and is obtained from coalesced type particles which are obtained by salting out/fusing resinous particles comprising said releasing agents in said binding resins and colorant particles.

The releasing agent employed invention is preferably a specified crystalline compound (crystalline ester) represented by the General Formula (1).

General Formula (1): $R^1—(OCO—R^2)_n$ wherein $R^1$ represents a hydrocarbon group having from 1 to 80 carbon atoms, which may have a substituent, or a group represented by formula of $(LK_1—X—LK_2)_m—$, wherein $LK_1$ and $LK_2$ represent a hydrocarbon group, which may have a substituent, and $LK_1$ and $LK_2$ may be same or different, m is a natural number of 1 or more, X represents 0 or —OCO—, $R^2$ represents a hydrocarbon group having from 1 to 80 carbon atoms, which may have a substituent, and n represents an integer of 1 to 15.

Esters which constitute the toner of the present invention may be suitably synthesized employing dehydration condensation reaction of alcohols with carboxylic acids.

Specific examples of specified compounds, which are employed in the toner of the present invention, include those represented by formulas 1) through 22).

(1)

$$CH_3—(CH_2)_{12}—COO—(CH_2)_{17}—CH_3$$

(2)

$$CH_3—(CH_2)_{18}—COO—(CH_2)_{17}—CH_3$$

(3)

$$CH_3—(CH_2)_{20}—COO—(CH_2)_{21}—CH_3$$

(4)

$$CH_3—(CH_2)_{14}—COO—(CH_2)_{19}—CH_3$$

(5)

$$CH_3—(CH_2)_{20}—COO—(CH_2)_6—O—CO—(CH_2)_{20}—CH_3$$

(6)

$$CH_3—(CH_2)_{20}-COO—(CH_2)_2—\underset{}{\overset{CH_3}{\overset{|}{CH}}}—CH_2—O—CO—(CH_2)_{20}-CH_3$$

(7)

$$CH_3—(CH_2)_{22}-COO—(CH_2)_2—\overset{CH_3}{\overset{|}{CH}}—CH_2—O—CO—(CH_2)_{22}-CH_3$$

(8)

$$CH_3—(CH_2)_{22}—COO—CH_2—\underset{CH_3}{\overset{CH_3}{\overset{|}{\underset{|}{C}}}}—CH_2—O—CO—(CH_2)_{22}—CH_3$$

-continued (9)

$$CH_3—(CH_2)_{26}-COO—CH_2—\underset{CH_3}{\overset{CH_3}{\overset{|}{\underset{|}{C}}}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)

$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

13)

$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)

$$\begin{array}{l} CH_2—OH \\ | \\ CH—OH \\ | \\ CH_2—O—CO—(CH_2)_{26}—CH_3 \end{array}$$

15)

$$\begin{array}{l} CH_2—OH \\ | \\ CH—OH \\ | \\ CH_2—O—CO—(CH_2)_{22}—CH_3 \end{array}$$

(16)

$$CH_3—(CH_2)_{26}—COO—CH_2—\overset{CH_3}{\overset{|}{\underset{CH_2—O—CO—(CH_2)_{26}—CH_3}{\underset{|}{C}}}}—CH_2—O—CO—(CH_2)_{26}—CH_3$$

(17)

$$CH_3—(CH_2)_{20}—COO—CH_2—\overset{CH_2CH_3}{\overset{|}{\underset{CH_2—O—CO—(CH_2)_{20}—CH_3}{\underset{|}{C}}}}—CH_2—O—CO—(CH_2)_{20}—CH_3$$

(18)

$$CH_3—(CH_2)_{26}—COO—CH_2—\overset{CH_2—O—CO—(CH_2)_{26}—CH_3}{\overset{|}{\underset{CH_2—O—CO—(CH_2)_{26}—CH_3}{\underset{|}{C}}}}—CH_2—O—CO—(CH_2)_{26}—CH_3$$

(19)

$$CH_3—(CH_2)_{20}—COO—CH_2—\overset{CH_2—O—CO—(CH_2)_{20}—CH_3}{\overset{|}{\underset{CH_2—O—CO—(CH_2)_{20}—CH_3}{\underset{|}{C}}}}—CH_2—O—CO—(CH_2)_{20}—CH_3$$

-continued (20)

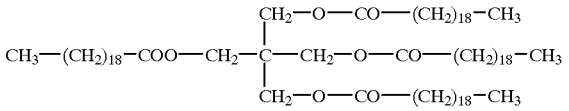

(21)

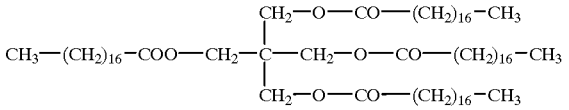

(22)

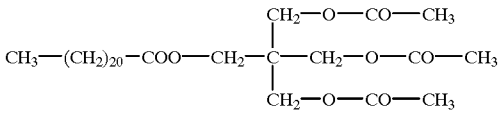

Content Ratio of Specified Crystalline Compounds

The content ratio of releasing agents in the toner of the present invention is commonly from 1 to 30 percent by weight, is preferably from 2 to 20 percent by weight, and is more preferably from 3 to 15 percent by weight.

Resinous Particles Comprising Releasing agents

The "resinous particles containing releasing agents", as described in the present invention, may be obtained as latex particles by dissolving releasing agents in monomers to obtain binding resins, then dispersing the resulting monomer solution into a water based medium, and subsequently polymerizing the resulting dispersion.

The weight average particle diameter of said resinous particles is preferably from 50 to 2,000 rim.

Listed as polymerization method employed to obtain resinous particles, in which binding resins comprise releasing agents, may be granulation polymerization methods such as an emulsion polymerization method, a suspension polymerization method, a seed polymerization method, and the like.

The following method (hereinafter referred to as an "mini-emulsion method") may be cited as a preferable polymerization method to obtain resinous particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical force. Subsequently, water-soluble polymerization initiators are added to the resulting dispersion and the resulting mixture undergoes radical polymerization. Further, instead of adding said water-soluble polymerization initiators, or along with said water-soluble polymerization initiators, oil-soluble polymerization initiators may be added to said monomer solution.

Herein, homogenizers which results in oil droplets in water dispersion, utilizing mechanical force, are not particularly limited, and may include "Clearmix" (produced by M Tech Co., Ltd.) provided with a high speed rotor, ultrasonic homogenizers, mechanical homogenizers, Manton-Gaulin homogenizers, pressure type homogenizers, and the like. Further, the diameter of dispersed particles is generally from 10 to 1,000 nm, and is preferably from 30 to 300 nm.

Binding Resins

Binding resins, which constitute the toner of the present invention, preferably comprise high molecular weight components having a peak, or a shoulder, in the region of from 100,000 to 1,000,000, as well as low molecular weight components having a peak, or a shoulder, in the region of from 1,000 to 20,000 in terms of the molecular weight distribution determined by GPC.

Herein, the method for measuring the molecular weight of resins, employing GPC, is as follows. Added to 1 cc of THF is a measured sample in an amount of from 0.5 to 5.0 mg (specifically, 1 mg), and is sufficiently dissolved at room temperature while stirring employing a magnetic stirrer and the like. Subsequently, after filtering the resulting solution employing a membrane filter having a pore size of from 0.48 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK quard column, and the like. Further, as a detector, a refractive index detector (IR detector) or a UV detector is preferably employed. When the molecular weight of samples is measured, the molecular weight distribution of said sample is calculated employing a calibration curve which is prepared employing a monodispersed polystyrene standard particles. Approximately ten polystyrenes samples are preferably employed for determining said calibration curve.

The composition materials of resinous particles and the preparation thereof will now be described.

(Monomers)

Of polymerizable monomers which are employed to prepare resinous particles, radical polymerizable monomers are essential components, and if desired, crosslinking agents may be employed. Further, at least one of said radical polymerizable monomers having an acidic group or radical polymerizable monomers having a basic group, described below, is preferably incorporated.

(1) Radical Polymerizable Monomers

Radical polymerizable monomers are not particularly limited, and conventional radical polymerizable monomers known in the art may be employed. Further, they may be employed in combination of two or more types, so that desired properties are obtained.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin based monomers, and the like.

Listed as aromatic vinyl monomers are, for example, styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrene, 3,4-dichlorostyrene, and the like.

Listed as acrylic or methacrylic acid ester based monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the properties of a toner, radical polymerizable crosslinking agents may be added as the crosslinking agents. Said radical polymerizable crosslinking agents include those having at least two unsaturated bonds, such as divinylbenzene, divinylnaphthalene, divinyl ether, diethylene glycol methacrylate, ethylene glycol dimethacrylate, polyethylene glycol dimethacrylate, diallyl phthalate, and the like.

(3) Radical Polymerizable Monomers Having an Acidic Group or Radical Polymerizable Monomers Having a Basic Group Employed as radical polymerizable monomers having an acidic group or radical polymerizable monomers having a basic group may be, for example, monomers having a carboxyl group, monomers having a sulfonic acid group, and amine based compounds such as primary, secondary, tertiary, quaternary ammonium salts, and the like.

Listed as radical polymerizable monomers having an acidic group are acrylic acid, methacrylic acid, fumaric acid, maleic acid, itaconic acid, cinnamic acid, monobutyl maleate, monooctyl maleate, and the like.

Listed as monomers having a sulfonic acid group are styrenesulfonic acid, allylsulfosuccinic acid, octyl allylsulfosuccinate, and the like.

These may form salts with alkali metals such as sodium, potassium, and the like or with alkali earth metals such as calcium and the like.

Listed as radical polymerizable monomers having a basic group may be amine based compounds such as dimethylaminoethyl acrylate, diethylaminoethyl methacrylate, diethylaminoethyl acrylate, diethylaminoethyl methacrylate, and quaternary ammonium salts of said four compounds; 3-dimethylaminophenyl acrylate, 2-hydroxy-3-methacryloxypropyltrimethyl ammonium salt, acrylamide, N-butylacrylamide, N,N-dibutylacrylamide, piperidylacrylamide, methacrylamide, N-butylmethacrylamide, N-octadecylacrylamide; vinylpyridine, vinylpyrrolidone; vinyl N-methylpyridinium chloride, vinyl N-ethylpyridinium chloride, N,N-diallylmethylammonium chloride, N,N-diallylethylammonium chloride; and the like.

When radical polymerizable monomers are employed to obtain the toner of the present invention, either radical polymerizable monomers having an acidic group or radical polymerizable monomers having a basic group are preferably employed in an amount of 0.1 to 15 percent by weight with respect to the total monomers, and radical polymerizable crosslinking agents are preferably employed in an amount of 0.1 to 10 percent by weight with respect to the total radical polymerizable monomers, though the amount depends on the properties of said crosslinking agents.

(4) Chain Transfer Agents

For the purpose of controlling the molecular weight of binder resins, it is possible to employ commonly used chain transfer agents.

Said chain transfer agents are not particularly limited, and for example, employed are mercaptans such as octylmercaptan, dodecylmercaptan, tert-dodecylmercaptan, and the like, and styrene dimers and the like.

(5) Polymerization Initiators

Radical polymerization imitators employed to obtain the toner of the present invention are not particularly limited, and it is possible to optionally use either water-soluble or oil-soluble polymerization initiators. Listed as water-soluble radical polymerization initiators are, for example, persulfate salts (such as potassium persulfate, ammonium persulfate, and the like), azo based compounds (such as 4,4'-azobis-cyanovaleric acid and salts thereof, 2,2'-azobis(2-amidinopropane) salt, and the like), peroxides, and the like.

Further, if desired, it is possible to convert said radical polymerization initiators to redox based initiators upon combining them with reducing agents. By employing said redox based initiators, it is possible to lower the polymerization temperature due to an increase in polymerization activity and thus to expect a decrease in the polymerization time.

Polymerization temperature may be optionally selected as long as said temperature exceeds the minimum radical forming temperature of said polymerization initiators. For example, the temperature range of 50 to 90° C. is employed. However, by employing a combination with polymerization initiators such as a combination of hydrogen peroxide-reducing agent (such as ascorbic acid and the like), capable of initiating the polymerization at room temperature, it is possible to carry out polymerization at room temperature or at higher temperature.

(6) Surface Active Agents

In order to carry out emulsion polymerization employing said radical polymerizable monomers, the addition of surface active agents is required. Said surface active agents, which are employed for the emulsion polymerization, are not particularly limited, and the ionic surface active agents shown below may be listed as suitable examples.

Listed as ionic surface active agents may be sulfonic acid salts (such as sodium dodecylbenzenesulfonate, sodium arylalkylpolyethersulfonate, sodium 3,3-disulfondiphenylurea-4,4-diazo-bisamino-8-naphthol-6-sulfonate, ortho-carboxybenzene-azo-dimethylaniline, sodium 2,2,5,5-tetramethyl-triphenylmethnae-4,4-diazo-bis-β-naphthol-6-sulfonate, and the like), sulfuric acid ester salts (such as sodium dodecylsulfate, sodium tetradecylsulfate, sodium pentadecylsulfate, sodium octylsulfate, and the like), fatty acid salts (such as sodium oleiate, sodium lauriate, sodium capriate, sodium capryliate, sodium caproate, potassium stearate, calcium oleiate, and the like.

Further, nonionic surface active agents may also be employed. Specifically cited may be polyethylene oxide, polypropylene oxide, a combination of polypropylene oxide and polyethylene oxide, esters of polyethylene glycol with higher fatty acids, esters of alkylphenolpolyethylene oxide and higher fatty acids with polyethylene glycol, esters of higher fatty acids with polypropylene oxide, sorbitan esters, and the like.

Colorants

Listed as colorants, which constitute part of the toner, may be inorganic pigments as well as organic pigments.

Employed as said inorganic pigments may be those conventionally known in the art. Specific inorganic pigments are shown below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

Employed as said organic pigments may be those conventionally known in the art. Specific organic pigments are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

If desired, these organic pigments may be employed individually or in combination of selected ones. Further, the added amount of pigments is commonly between 2 and 20 percent by weight, and is preferably between 3 and 15 percent by weight.

Said colorants may also be employed while being subjected to surface modification. As said surface modifying agents may be those conventionally known in the art, and specifically, employed preferably may be silane coupling agents, titanium coupling agents, aluminum coupling agents, and the like.

External Additives

For the purpose of improving fluidity as well as chargeability, and of enhancing cleaning properties, the toner of the present invention may be employed into those in which so-called external additives are incorporated. Said external additives are not particularly limited, and various types of fine inorganic particles, fine organic particles, and lubricants may be employed.

Employed as fine inorganic particles may be those conventionally known in the art. Specifically, it is possible to preferably employ fine silica, titanium, and alumina particles and the like. These fine inorganic particles are preferably hydrophobic. Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of from 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably from 0.1 to 5 percent by weight with respect to the toner.

The toner of the present invention is a coalesced type toner obtained by salting out/fusing resinous particles comprising releasing agents and colorant particles in a water based medium. By salting out/fusing said resinous particles comprising releasing agents, as described above, a toner is obtained in which said releasing agents are finely depressed.

In addition, the toner of the present invention possesses an uneven surface from the production stage, and a coalesced type toner is obtained by fusing resinous particles and colorant particles. Therefore, differences in the shape as well as surface properties among toner particles are minimal. As a result, the surface properties tend to be uniform. Thus difference in fixability among toner particles tends to be minimized so that it is possible to maintain excellent fixability.

Toner Production Process

One example of the method for producing the toner of the present invention is as follows:

(1) a dissolution process in which releasing agents are dissolved in monomers and a monomer solution is prepared (2) a dispersion process in which the resulting monomer solution is dispersed into a water based medium (3) a polymerization process in which the resulting water based dispersion of said monomer solution undergoes polymerization so that a dispersion (latex) of resinous particles comprising said releasing agents is prepared (4) a salting-out/fusion process in which the resulting resinous particles and said colorant particles are subjected to salting-out/fusion in a water based medium so as to obtain coalesced particles (toner particles)

(5) a filtration and washing process in which the resulting coalesced particles are collected from the water based medium employing filtration, and surface active agents and the like are removed from said coalesced particles (6) a drying process in which washed coalesced particles are dried, and (7) an external addition process may be included in which external agents are added to the dried coalesced particles.

(Dissolution Process)

Methods for dissolving releasing agents in monomers are not particularly limited.

The dissolved amount of said releasing agents in said monomers is determined as follows: the content ratio of releasing agents is generally from 1 to 30 percent by weight with respect of the finished toner, is preferably from 2 to 20 percent by weight, and is more preferably from 3 to 15 percent by weight.

Further, oil-soluble polymerization initiators as well as other oil-soluble components may be incorporated into said monomer solution.

(Dispersion Process)

Methods for dispersing said monomer solution into a water based medium are not particularly limited. However, methods are preferred in which dispersion is carried out employing mechanical force. Said monomer solution is preferably subjected to oil droplet dispersion (essentially an embodiment in a mini-emulsion method), employing mechanical force, especially into a water based medium prepared by dissolving a surface active agent at a concentration of lower than its critical micelle concentration.

Herein, homogenizers to conduct oil droplet dispersion, employing mechanical forces, are not particularly limited, and include, for example, "Clearmix", ultrasonic homogenizers, mechanical homogenizers, and Manton-Gaulin homogenizers and pressure type homogenizers. Further, the diameter of dispersed particles is from 10 to 1,000 nm, and is preferably be from 30 to 300 nm.

(Polymerization Process)

In the polymerization process, polymerization methods (granulation polymerization methods such as an emulsion polymerization method, a suspension polymerization method, and a seed polymerization method), which are conventionally known in the art, may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

(Salting-out/Fusion Process)

In the salting-out/fusion process, a colorant particle dispersion is added to a dispersion comprised of resinous particles obtained by said polymerization process so that said resinous particles and said colorant particles are subjected to salting-out/fusion in a water based medium.

Further, in said salting-out/fusion process, resinous particles as well as colorant particles may be fused with internal agent particles and the like.

"Water based medium", as described in said salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare fine colorant particles by dispersing said colorant into a water based medium. The dispersion treatment of said colorant is carried out in a state in which the concentration of surface active agents in water is adjusted to be higher than the critical micelle concentration (CMC).

Homogenizers, which are employed to carry out dispersion treatment of colorants, are not particularly limited, but listed as preferred homogenizers are ultrasonic homogenizers, mechanical homogenizers, pressurized homogenizers such as a Manton-Gaulin homogenizer and pressure type homogenizers, and medium type homogenizers such as a sand grinder, a Getman mill, a diamond fine mill, and the like. In addition, listed as employed surface active agents may be those which are the same as described above.

Further, colorants (fine particles) may be subjected to surface modification. The surface modification method applied to said colorants is as follows. Colorants are dispersed into a solvent, and surface modification agents are added to the resultant dispersion. The resultant system is heated enough to initiate a reaction. After completion of the reaction, said colorants are collected through filtration, and washing, as well as filtration is repeated while employing the same solvent and subsequently dried whereby colorants (pigments), which have been subjected to treatment employing said surface modification agents, are obtained.

The salting-out/fusion process is accomplished as follows. Salting-out agents, comprised of alkaline metal salts and/or alkaline earth metal salts and the like, are added to water comprising resinous particles as well as colorant particles as the coagulant at a concentration of higher than critical aggregation concentration. Subsequently, the resulting aggregation is heated above the glass transition point of said resinous particles so that fusion is carried out while simultaneously conducting salting-out. During this process, organic solvents, which are infinitely soluble in water, may be added.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Further, listed as organic solvents which are infinitely soluble in water are methanol, ethanol, 1-propanol, 2-propanol, ethylene glycol, glycerin, acetone, and the like. Of these, preferred are alcohols having 3 or fewer carbon atoms such as methanol, ethanol, 1-propnaol, 2-propanol, and 2-propanol is particularly preferred.

In the salting-out/fusion process, it is preferable that hold-over time after the addition of salting-out agents is as short as possible. Namely it is preferable that after the addition of salting-out agents, a dispersion comprised of resinous particles and colorant particles is heated as soon as possible and heated to a temperature higher than the glass transition point of said resinous particles.

The reason for this is not well understood. However, problems occur in which the aggregation state of particles varies depending on the hold-over time after salting out so that the particle diameter distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resinous particles.

Further, it is required that in the salting-out/fusion process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting-out/fusion, said rate is preferably not more than 15° C./minute.

Further, after the dispersion comprised of resinous particles and colorant particles is heated to a higher temperature than said glass transition point, it is important to continue the salting-out/fusion by maintaining the temperature of said dispersion for a specified period of time. By so doing, it is possible to effectively proceed with the growth of toner particles (aggregation of resinous particles as well as colorant particles) and fusion (disappearance of the interface between particles. As a result, it is possible to enhance the durability of the finally obtained toner.

Further, after terminating the growth of coalesced particles, fusion by heating may be continued.

(Filtration and Washing Process)

In said filtration and washing process, filtration is carried out in which said toner particles are collected from the toner particle dispersion, cooled to the specified temperature, which is no higher than $t_{1m}$−30° C. during said process, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing a glass filter and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

(Addition Process of External Additives)

This process is one in which external additives are added to dried toner particles.

Listed as devices which are employed for the addition of external additives, may be various types of mixing devices known in the art, such as tubular mixers, Henschel mixers, Nauter mixers, V-type mixers, and the like.

Herein, the toner particle diameter of the present invention is from 3 to 9 μm in terms of the volume average particle diameter. It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like. Herein values are shown which are obtained based on the particle diameter distribution in the range of from 2.0 to 40 μm, employing an aperture having an aperture diameter of 100 μm of said Coulter Counter TA-II as well as said Coulter Multisizer.

Further, the toner of the present invention is preferred in which the amount of minute toner powder having a diameter of not more than 2.0 μm is not more than 20 percent by number with respect to the total in term of the number distribution, and is more preferred in which the amount of minute toner powder particles having a diameter of not more than 2.0 μm is not more than 10 percent by number. It is possible to determine the amount of said minute toner powder particles employing a electrophoresis light scattering photometer ELS-800, produced by Otsuka Denshi Co. In order to adjust the particle diameter distribution to said range, the temperature during the salting-out/fusion stage, is preferably controlled in the narrow range. Specifically, the temperature is quickly increased, that is, the temperature increase rate is enhanced. These conditions have been described previously. The time to increase the temperature to said specified value is generally less than 30 minutes, and is preferably less than 10 minutes, and the temperature increase rate is preferably from 1 to 15° C./minute.

Further, as the toner shape of the present invention, an average value (an average circularity) of the shape coefficient (circularity) described by the formula shown below is preferably from 0.930 to 0.980, and is more preferably from 0.940 to 0.975.

Shape coefficient=(circumferential length of a circle obtained based on the diameter equivalent to a circle)/(circumferential length of the projected toner image)

By adjusting said average circularity to the range of from 0.930 to 0.980, it is possible to make the toner shape undefined and to make heat transfer more efficient so that fixability can be further improved. Namely, by adjusting the average circularity to not more than 0.980, it is possible to enhance fixability. Further by adjusting the average circularity to at least 0.930, the degree of undefined particle shape is controlled so that pulverization properties of particles due to stress during extended use can be retarded.

Further, the shape coefficient preferably has a narrow distribution, and the standard deviation of the circularity is preferably not more than 0.10. The CV value obtained by the formula shown below is preferably less than 20 percent, and is more preferably less than 10 percent.

CV value=(standard deviation of circularity/average circularity)×100

By adjusting the standard deviation of the circularity to not more than 0.10, it is possible to prepare toner particles having a uniform shape and to minimize the difference in fixability between toner particles. As a result, an increase in the fixing ratio as well as effects to minimize staining of the fixing unit is further exhibited. Further, by adjusting the CV value to less than 20 percent, it is possible to narrow the size distribution in the same manner and to more markedly exhibit fixability enhancing effects.

Methods for measuring said shape coefficient are not limited. For example, toner particles are enlarged by a factor of 500 employing an electron microscope and photographed. Subsequently, the circularity of at least 500 toner particles is determined, employing an image analysis apparatus. The arithmetic average is then obtained so that an average circularity can be calculated. Further, as a simple measurement method, it is possible to conduct measurement, employing FPIA-1000 (produced by to a Iyodenshi Co., Ltd.).

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resinous particles as well as colorant particles so as to be incorporated into the toner, another is one in which said charge control agents are added to resinous particles, and the like.

In the same manner, it is possible to employ various charge control agents known in the art, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

Developers

The toner of the present invention may be employed in either a single-component developer or a two-component developer.

Listed as single-component developers are a non-magnetic single-component developer, and a magnetic single-component developer in which magnetic particles having a diameter of 0.1 to 0.5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably from 15 to 100 $\mu$m. and is more preferably from 25 to 80 $\mu$m.

The volume average particle diameter of said carrier can be generally determined employing a laser diffraction type particle size distribution measurement apparatus "Helos", produced by Sympatec Co., which is provided with a wet type homogenizer.

Preferred carrier is one in which magnetic particles are further coated with resins or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

Color images formed by the toner (image forming method) of the present invention are preferably semi-gloss images.

The "semi-gloss images", as described herein, refer to images having a standard glossiness of 17 to 37 (refer to Japanese Patent Publication Open to Public Inspection No. 9-138538). Semi-gloss images having a standard glossiness in the range of 11 to 37 exhibit gloss (surface smoothness) required to obtain color reproduction properties of color images as well as a decrease in surface reflection (matting properties) required for office documents.

Namely, in color toner images in which desired colors are formed by laminating toner layers, it is preferable that the surface of each color toner layer is smoothed.

However, as the surface smoothness of said toner layer increase, the glossiness of images increases. In such a case, it becomes difficult to see said images (specifically, text images and symbols) due to reflected light from those.

Therefore, by controlling said standard glossiness to the range of 13 to 37, it is possible to satisfactorily balance color reproduction properties of color images and the ease of reading text images and the like. Herein, the standard glossiness is preferably in the range of 17 to 27.

(Measurement Method of Standard Glossiness)

(1) Measured Area

The standard glossiness is measured in an area in which the toner covering ratio on a image forming support is 90 percent by area. Herein, said toner covering ratio is determined by employing a high speed color image analysis apparatus "SPICCA" (produced by Nihon Avionics Co.).

(2) Measurement Method

Said area is measured at an incident angle of 75 degrees employing a gloss meter VGS-1D (produced by Nihon Senshoku Kogyo Co., Ltd.), in accordance with Method 2 described in JIS-Z8741-1983.

EXAMPLES

The present inventing will now be detailed with reference to examples. Incidentally, "parts" in the following description is parts by weight, unless otherwise specified.

Preparation Example 1

Placed into a 5,000 ml separable flask fitted with a stirring unit, a temperature sensor, a cooling pipe, and a nitrogen gads inlet unit was a surface active agent solution (water based medium) prepared by dissolving 7.08 g of an anionic surface active agent (sodium dodecylbenezenesulfonate: SDS) in 2,760 g of deionized water, and the interior temperature was raised to 80° C. under a nitrogen gas flow while stirring at 230 rpm.

On one side, a monomer solution was prepared by adding 72.0 g of the compound represented by the aforementioned formula 20) (hereinafter referred to as "Exemplified Compound (20)") to a monomer mixture solution consisting of 115.1 g of styrene, 42.0 g of n-butyl acrylate, and 10.9 g of methacrylic acid followed by being dissolved while heated to 80° C.

Said monomer solution (at 80° C.) was mixed with and dispersed into said surface active agent solution employing a mechanical type homogenizer, having a circulation channel, and a dispersion comprised of emulsion particles (oil droplets), having a uniform dispersed particle diameter, was prepared.

Subsequently, a solution prepared by dissolving 0.84 g of a polymerization initiator (potassium persulfate: KPS) in 200 g of deionized water was added to the resulting dispersion, and the resulting mixture underwent polymerization (a fist stage polymerization) while being heated to 80° C. and stirred for 3 hours, whereby latex was prepared.

Subsequently, a solution prepared by dissolving 7.73 g of said polymerization initiator (KPS) in 240 ml of deionized water was added to the resulting latex. After 15 minutes, a monomer mixture solution consisting of 383.6 g of styrene, 140.0 g of n-butyl acrylate, 36.4 g of methacrylic acid, and 13.7 g of t-dodecylmercaptan was added dropwise over 126 minutes. After the dropwise addition, the resulting mixture underwent polymerization (a second stage polymerization) while stirring for 60 minutes, and then cooled to 40° C. Thus latex (a dispersion comprised of core shell structure resinous particles having releasing agents in the core) was obtained. The resulting latex was designated as "Latex (1)".

Preparation Example 2

Latex (a dispersion comprised of core shell structure resinous particles having releasing agents in the core) was obtained in the same manner as Preparation Example 1, except that the added amount of Exemplified Compound (20) was varied to 60.0 g. The resulting latex was designated as "Latex (2)".

Preparation Example 3

Latex (a dispersion comprised of core shell structure resinous particles having releasing agents in the core) was obtained in the same manner as Preparation Example 1, except that the added amount of Exemplified Compound (20) was varied to 96.0 g. The resulting latex was designated as "Latex (3)".

Preparation Example 4

Latex (a dispersion comprised of core shell structure resinous particles having releasing agents in the core) was obtained in the same manner as Preparation Example 1, except that the added amount of Exemplified Compound (20) was varied to 120.0 g. The resulting latex was designated as "Latex (4)".

Preparation Example 5

Latex (a dispersion comprised of core shell structure resinous particles having releasing agents in the core) was obtained in the same manner as Preparation Example 1, except that Exemplified Compound (20) was replaced with 72.0 g of the compound represented by the aforementioned formula 19) (hereinafter referred to as "Exemplified Compound (19)"). The resulting latex was designated as "Latex (5)".

Preparation Example 6

Latex (a dispersion comprised of core shell structure resinous particles having releasing agents in the core) was obtained in the same manner as Preparation Example 1, except that Exemplified Compound (20) was replaced with 72.0 g of the compound represented by the aforementioned formula 18) (hereinafter referred to as "Exemplified Compound (18)"). The resulting latex was designated as "Latex (6)".

Preparation Example 7

Latex (a dispersion comprised of core shell structure resinous particles having releasing agents in the core) was obtained in the same manner as Preparation Example 1, except that Exemplified Compound (20) was replaced with 120.0 g of the compound represented by the aforementioned formula 8) (hereinafter referred to as "Exemplified Compound (8)"). The resulting latex was designated as "Latex (7)".

Preparation Example 8

Latex (a dispersion comprised of core shell structure resinous particles having releasing agents in the core) was obtained in the same manner as Preparation Example 2, except that the added amount of potassium persulfate, which was added to perform the first stage polymerization (synthesis of high molecular weight components), was varied to 0.42 g. The resulting latex was designated as "Latex (8)".

Preparation Example 9

Latex (a dispersion comprised of core shell structure resinous particles having releasing agents in the core) was obtained in the same manner as Preparation Example 2, except that the added amount of potassium persulfate, which was added to perform the second stage polymerization (synthesis of low molecular weight components), was varied to 9.276 g. The resulting latex was designated as "Latex (9)".

Preparation Example 10

Latex (a dispersion comprised of core shell structure resinous particles having releasing agents in the core) was obtained in the same manner as Preparation Example 2, except that the added amount of t-dodecylmercaptan (chain transfer agent), which was added to perform the second stage polymerization (synthesis of low molecular weight components), was varied to 16.44 g. The resulting latex was designated as "Latex (10)".

Preparation Example 11

Placed into a 5,000 ml separable flask fitted with a stirring unit and a temperature sensor, a cooling unit, and nitrogen gas inlet unit was a surface active agent solution (water based medium) prepared by dissolving 8.4 g of an anionic surface active agent (sodium dodecylbenezenesulfonate: SDS) in 2,760 g of deionized water, and the interior temperature was raised to 80° C. under a nitrogen gas flow while stirring at 230 rpm.

On one side, a monomer solution was prepared by adding 86.4 g of Exemplified Compound (20) to a monomer mixture solution consisting of 138.1 g of styrene, 50.4 g of n-butyl acrylate, and 13.1 g of methacrylic acid followed by being dissolved while heated to 80° C.

Said monomer solution (at 80° C.) was mixed with and dispersed into said surface active agent solution employing a mechanical type homogenizer, having a circulation channel, and a dispersion comprised of emulsion particles (oil droplets), having a uniform dispersed particle diameter, was prepared.

Subsequently, a solution prepared by dissolving 0.84 g of a polymerization initiator (potassium persulfate: KPS) in 200 g of deionized water was added to the resulting dispersion, and the resulting mixture underwent polymerization (a fist stage polymerization) while being heated to 80° C. and stirred for 3 hours, whereby latex was prepared.

Subsequently, a solution prepared by dissolving 6.0 g of said polymerization initiator (KPS) in 240 ml of deionized water was added to the resulting latex. After 15 minutes, a monomer mixture solution consisting of 306.9 g of styrene, 112.0 g of n-butyl acrylate, 29.12 g of methacrylic acid, and 10.96 g of t-dodecylmercaptan was added dropwise over 120 minutes. After the dropwise addition, the resulting mixture underwent polymerization (a second stage polymerization) while stirring for 60 minutes, and then cooled to 40° C. Thus latex (a dispersion comprised of core shell structure resinous particles having releasing agents in the core) was obtained. The resulting latex was designated as "Latex (11)".

Preparation Example 12

Placed into a 5,000 ml separable flask, fitted with a stirring unit and a temperature sensor, a cooling pipe, and nitrogen gas inlet unit, was a surface active agent solution (water based medium) prepared by dissolving 5.6 g of an anionic surface active agent (sodium dodecylbenezenesulfonate: SDS) in 2,760 g of deionized water, and the interior temperature was raised to 80° C. under a nitrogen gas flow while stirring at 230 rpm.

On one side, a monomer solution was prepared by adding 75.6 g of Exemplified Compound (20) to a monomer mixture solution consisting of 92.1 g of styrene, 33.6 g of n-butyl acrylate, and 8.7 g of methacrylic acid followed by being dissolved while heated to 80° C.

Said monomer solution (at 80° C.) was mixed with and dispersed into said surface active agent solution employing a mechanical type homogenizer, having a circulation channel, and a dispersion comprised of emulsion particles (oil droplets), having a uniform dispersed particle diameter, was prepared.

Subsequently, a solution prepared by dissolving 0.6 g of a polymerization initiator (potassium persulfate: KPS) in 200 g of deionized water was added to the resulting dispersion, and the resulting mixture underwent polymerization (a fist stage polymerization) while being heated to 80° C. and stirred for 3 hours, whereby latex was prepared.

Subsequently, a solution prepared by dissolving 9.1 g of said polymerization initiator (KPS) in 240 ml of deionized water was added to the resulting latex. After 15 minutes, a monomer mixture solution consisting of 498.7 g of styrene, 182.0 g of n-butyl acrylate, 47.3 g of methacrylic acid, and 17.8 g of t-dodecylmercaptan was added dropwise over 120 minutes. After the dropwise addition, the resulting mixture underwent polymerization (a second stage polymerization) while stirring for 60 minutes, and then cooled to 40° C. Thus latex (a dispersion comprised of core shell structure resinous particles having releasing agents in the core) was obtained. The resulting latex was designated as "Latex (12)".

Production Example 1Bk

Added to 160 ml of deionized water were 9.2 g of sodium n-dodecylsulfate and were dissolved while stirring. While stirring the resulting solution, 20 g of carbon black, "Regal 330R" (produced by Cabot Corp.), were gradually added, and subsequently dispersed employing a stirring unit, "Clearmix" (produced by M Tech Ltd.) equipped with a high speed rotating rotor. Thus a colorant particle dispersion (hereinafter referred to as "Colorant Dispersion " (1)) was prepared. The colorant particle diameter of said Colorant Dispersion (1) was determined employing an electrophoresis light scattering photometer "ELS-800" (produced by Ohtsuka Denshi Co.), resulting in a weight average particle diameter of 112 nm.

Placed into a 5-liter four-necked flask fitted with a temperature sensor, a cooling pipe, a nitrogen gas inlet unit, and a stirring unit were 1250 g of Latex (1) obtained in Preparation Example 1, 2000 ml of deionized water, and Colorant Dispersion (1) prepared as previously described, and the resulting mixture was stirred. After adjusting the interior temperature to 30° C., 5N aqueous sodium hydroxide solution was added to the resulting solution, and the pH was adjusted to 10.0. Subsequently, an aqueous solution prepared by dissolving 52.6 g of magnesium chloride tetrahydrate in 72 ml of deionized water was added at 30° C. over 10 minutes. After setting aside for 3 minutes, the resulting mixture was heated so that the temperature was increased to 90° C. within 6 minutes (at a temperature increase rate of 10° C./minute). While maintaining the resulting state, the diameter of coalesced particles was measured employing a "Coulter Counter TA-II". When the volume average particle diameter reached 6.5 $\mu$m, the growth of particles was terminated by the addition of an aqueous solution prepared by dissolving 115 g of sodium chloride in 700 ml of deionized water, and further fusion was continually carried out at a liquid media temperature of 90±2° C. for 6 hours while being heated while stirring. Thereafter, the temperature was decreased to 30° C. at a rate of 6° C./minute. Subsequently, the pH was adjusted to 2.0, and stirring was terminated. The resulting coalesced particles were collected through filtration, and repeatedly washed with deionized water. Then washed particles were dried by 40° C. air, resulting in colored particles. The colored particles obtained as previously described were designated as "Colored Particles 1Bk".

Production Examples 2Bk through 12Bk

Colored particles were obtained in the same manner as Production Example 1Bk, except that in accordance with formulas of Table 1 shown below, the types of latexes were varied and in Production Examples 7Bk, 8SBk, and 12Bk, carbon black "Regal 330R" was replaced with 20 g of carbon black "Mogal L". Colored particles obtained as above were designated as "Colored Particles 2Bk through 12Bk".

With each of Colored Particles 1Bk through 12Bk obtained as above, determined were the average of circularity (average circularity), the standard deviation of circularity, CV values of circularity, the volume average particle diameter, the peak molecular weight of high molecular weight components, the peak molecular weight of low molecular weight components, and the molecular weights (number average molecular weight and weight average molecular weight). Table 1 shows the entire results.

TABLE 1

| Colored Particles | Latex | Average Circularity | Standard Deviation of Circularity | CV Value of Circularity | Volume Average Particle Diameter (in $\mu$m) |
|---|---|---|---|---|---|
| Colored Particles 1Bk | Latex(1) | 0.963 | 0.031 | 3.2 | 6.7 |
| Colored Particles 2Bk | Latex(2) | 0.966 | 0.036 | 3.7 | 6.6 |
| Colored Particles 3Bk | Latex(3) | 0.962 | 0.042 | 4.4 | 6.8 |
| Colored Particles 4Bk | Latex(4) | 0.973 | 0.051 | 5.2 | 6.9 |
| Colored Particles 5Bk | Latex(5) | 0.970 | 0.034 | 3.5 | 6.3 |
| Colored Particles 6Bk | Latex(6) | 0.954 | 0.031 | 3.2 | 6.8 |
| Colored Particles 7Bk | Latex(7) | 0.962 | 0.035 | 3.6 | 7.3 |
| Colored Particles 8Bk | Latex(8) | 0.957 | 0.032 | 3.3 | 6.2 |
| Colored Particles 9Bk | Latex(9) | 0.972 | 0.038 | 3.9 | 6.9 |
| Colored Particles 10Bk | Latex(10) | 0.965 | 0.032 | 3.3 | 6.9 |
| Colored Particles 11Bk | Latex(11) | 0.961 | 0.030 | 3.1 | 6.2 |
| Colored Particles 12Bk | Latex(12) | 0.966 | 0.032 | 3.3 | 6.1 |

| | Peak Molecular Weight | | Molecular Weight of Individual Resin | |
|---|---|---|---|---|
| Colored Particles | High Molecular Weight Components | Low Molecular Weight Components | Number Average Molecular Weight | Weight Average Molecular Weight |
| Colored Particles 1Bk | 242,000 | 19,000 | 5,900 | 43,000 |
| Colored Particles 2Bk | 242,000 | 19,000 | 5,900 | 43,000 |
| Colored Particles 3Bk | 242,000 | 19,000 | 5,900 | 43,000 |
| Colored Particles 4Bk | 242,000 | 19,000 | 5,900 | 43,000 |
| Colored Particles 5Bk | 242,000 | 19,000 | 5,900 | 43,000 |
| Colored Particles 6Bk | 242,000 | 19,000 | 5,900 | 43,000 |
| Colored Particles 7Bk | 242,000 | 19,000 | 6,300 | 56,000 |
| Colored Particles 8Bk | 369,000 | 19,000 | 7,200 | 69,000 |
| Colored Particles 9Bk | 242,000 | 12,000 | 4,200 | 42,000 |
| Colored Particles 10Bk | 242,000 | 19,000 | 4,300 | 42,000 |
| Colored Particles 11Bk | 242,000 | 19,000 | 6,500 | 72,000 |

TABLE 1-continued

| | | | | |
|---|---|---|---|---|
| Colored Particles 12Bk | 242,000 | 19,000 | 4,200 | 39,000 |

weight of low molecular weight components, the molecular weight of an individual resin (number average molecular weight and weight average molecular weight) of each of Colored Particles 1Y through 12Y was the same as each of those of Colored Particles 1Bk through 12 Bk (colored particles prepared by utilizing the same latex).

TABLE 2

| Colored Particles | Latex | Colorant | Average Circularity | Standard Deviation of Circularity | CV Value of Circularity (in %) | Volume Average Particle Diameter (in μm) |
|---|---|---|---|---|---|---|
| Colored Particles 1Y | Latex (1) | C.I. Solvent Yellow 93 | 0.965 | 0.033 | 3.4 | 6.8 |
| Colored Particles 2Y | Latex (2) | C.I. Solvent Yellow 93 | 0.966 | 0.036 | 3.7 | 6.5 |
| Colored Particles 3Y | Latex (3) | C.I. Solvent Yellow 93 | 0.961 | 0.045 | 4.7 | 6.8 |
| Colored Particles 4Y | Latex (4) | C.I. Solvent Yellow 93 | 0.974 | 0.052 | 5.3 | 7.1 |
| Colored Particles 5Y | Latex (5) | C.I. Solvent Yellow 162 | 0.971 | 0.032 | 3.3 | 6.2 |
| Colored Particles 6Y | Latex (6) | C.I. Solvent Yellow 162 | 0.956 | 0.030 | 3.1 | 6.9 |
| Colored Particles 7Y | Latex (7) | C.I. Solvent Yellow 93 | 0.963 | 0.034 | 3.5 | 7.1 |
| Colored Particles 8Y | Latex (8) | C.I. Solvent Yellow 93 | 0.955 | 0.033 | 3.5 | 6.3 |
| Colored Particles 9Y | Latex (9) | C.I. Solvent Yellow 185 | 0.971 | 0.037 | 3.8 | 6.9 |
| Colored Particles 10Y | Latex (10) | C.I. Solvent Yellow 185 | 0.962 | 0.032 | 3.3 | 6.8 |
| Colored Particles 11Y | Latex (11) | C.I. Solvent Yellow 185 | 0.963 | 0.031 | 3.2 | 6.1 |
| Colored Particles 12Y | Latex (12) | C.I. Solvent Yellow 93 | 0.967 | 0.032 | 3.3 | 6.2 |

Production Example 1Y

Colored particles were obtained in the same manner as Production Example 1Bk, except that based on the formulas shown Table 2 below, carbon black was replaced with dye for yellow (C.I. Solvent Yellow 93) in an amount of 20 g. The colored particles obtained as above were designated as "Colored Particles 1Y".

Production Examples 2Y through 12Y

Colored particles were obtained in the same manner as Production Example 1Y, except that latexes were varied based on formulas shown in Table 2 below and colorants shown in Table 2 below were employed. The colored particles obtained as above were designated as "Colored Particles 2Y" through "Colored Particles 12Y".

With each of Colored Particles 1Y through 12Y obtained as above, determined were the average of circularity (average circularity), the standard deviation of circularity, CV values of circularity, the volume average particle diameter. Table 2 below shows the results.

Further, each measure value of the peak molecular weight of high molecular weight components, the peak molecular Production Example 1M Colored particles were obtained in the same manner as Production Example 2Bk, except that based on the formulas shown Table 3 below, carbon black was replaced with pigment for red (C.I. Pigment Red 122) in an amount of 20 g. The colored particles obtained as above were designated as "Colored Particles 1M".

Production Examples 2M through 12M

Colored particles were obtained in the same manner as Production Example 1M, except that the types of latexes were varied based on formulas shown in Table 3 below and C.I. Pigment Red 122 was replaced with "Carmine 6B" in an amount of 20 g. The colored particles obtained as above were designated as "Colored Particles 2M" through "Colored Particles 12M".

With each of Colored Particles 1M through 12M obtained as above, determined were the average of circularity (average circularity), the standard deviation of circularity, CV values of circularity, the volume average particle diameter. Table 3 below shows the results.

Further, each measure value of the peak molecular weight of high molecular weight components, the peak molecular weight of low molecular weight components, the molecular weight of an individual resin (number average molecular weight and weight average molecular weight) of each of Colored Particles 1Bk throught 12 Bk (colored particles prepared by utilizing the same latex).

TABLE 3

| Colored Particles | Latex | Colorant | Average Circularity | Standard Deviation of Circularity | CV Value of Circularity (in %) | Volume Average Particle Diameter (in μm) |
|---|---|---|---|---|---|---|
| Colored Particles 1M | Latex (1) | C.I. Pigment Red 122 | 0.969 | 0.031 | 3.2 | 6.6 |
| Colored Particles 2M | Latex (2) | C.I. Pigment Red 122 | 0.967 | 0.038 | 3.9 | 6.6 |
| Colored Particles 3M | Latex (3) | C.I. Pigment Red 122 | 0.965 | 0.044 | 4.6 | 6.7 |
| Colored Particles 4M | Latex (4) | C.I. Pigment Red 122 | 0.970 | 0.050 | 5.2 | 6.9 |
| Colored Particles 5M | Latex (5) | C.I. Pigment Red 122 | 0.969 | 0.033 | 3.4 | 6.4 |
| Colored Particles 6M | Latex (6) | C.I. Pigment Red 122 | 0.957 | 0.033 | 3.4 | 6.9 |
| Colored Particles 7M | Latex (7) | C.I. Pigment Red 122 | 0.965 | 0.036 | 3.7 | 7.0 |
| Colored Particles 8M | Latex (8) | C.I. Carmine 6B | 0.955 | 0.035 | 3.7 | 6.4 |
| Colored Particles 9M | Latex (9) | C.I. Pigment Red 122 | 0.970 | 0.035 | 3.6 | 7.0 |
| Colored Particles 10Bk | Latex (10) | C.I. Pigment Red 122 | 0.965 | 0.031 | 3.2 | 6.9 |
| Colored Particles 11M | Latex (11) | C.I. Pigment Red 122 | 0.962 | 0.029 | 3.0 | 6.0 |
| Colored Particles 12M | Latex (12) | C.I. Carmine 6B | 0.969 | 0.030 | 3.1 | 6.3 |

Production Example 1C

Colored particles were obtained in the same manner as Production Example 1Bk, except that carbon black was replaced with pigment for blue (C.I. Pigment Blue 15:3) in an amount of 20 g. The colored particles obtained as above were designated as "Colored Particles IC".

Production Examples 2C through 12C

Colored particles were obtained in the same manner as Production Example 1C, except that the types of latexes were varied based on formulas shown in Table 4. The colored particles obtained as above were designated as "Colored Particles 2C" through "Colored Particles 12C".

With each of Colored Particles IC through 12C obtained as above, determined were the average of circularity (average circularity), the standard deviation of circularity, CV values of circularity, the volume average particle diameter. Table 4 below shows the results.

Further, each measure value of the peak molecular weight of high molecular weight components, the peak molecular weight of low molecular weight components, the molecular weight of an individual resin (number average molecular weight and weight average molecular weight) of each of Colored Particles 1C through 12C was the same as each of Colored Particles 1 Bk through 12 Bk (colored particles prepared by utilizing the same latex).

TABLE 4

| Colored Particles | Latex | Colorant | Average Circularity | Standard Deviation of Circularity | CV Value of Circularity (in %) | Volume Average Particle Diameter (in μm) |
|---|---|---|---|---|---|---|
| Colored Particles 1C | Latex (1) | C.I. Pigment Blue 15:3 | 0.966 | 0.033 | 3.4 | 6.9 |
| Colored Particles 2C | Latex (2) | C.I. Pigment Blue 15:3 | 0.969 | 0.037 | 3.8 | 6.7 |
| Colored Particles 3C | Latex (3) | C.I. Pigment Blue 15:3 | 0.966 | 0.045 | 4.7 | 6.7 |
| Colored Particles 4C | Latex (4) | C.I. Pigment Blue 15:3 | 0.972 | 0.051 | 5.2 | 6.8 |
| Colored Particles 5C | Latex (5) | C.I. Pigment Blue 15:3 | 0.970 | 0.034 | 3.5 | 6.3 |
| Colored Particles 6C | Latex (6) | C.I. Pigment Blue 15:3 | 0.956 | 0.031 | 3.2 | 6.7 |
| Colored Particles 7C | Latex (7) | C.I. Pigment Blue 15:3 | 0.964 | 0.035 | 3.6 | 7.2 |
| Colored Particles 8C | Latex (8) | C.I. Pigment Blue 15:3 | 0.956 | 0.034 | 3.6 | 6.4 |
| Colored Particles 9C | Latex (9) | C.I. Pigment Blue 15:3 | 0.970 | 0.039 | 4.0 | 6.8 |

TABLE 4-continued

| Colored Particles | Latex | Colorant | Average Circularity | Standard Deviation of Circularity | CV Value of Circularity (in %) | Volume Average Particle Diameter (in μm) |
|---|---|---|---|---|---|---|
| Colored Particles 10C | Latex (10) | C.I. Pigment Blue 15:3 | 0.966 | 0.032 | 3.3 | 6.8 |
| Colored Particles 11C | Latex (11) | C.I. Pigment Blue 15:3 | 0.963 | 0.030 | 3.1 | 6.2 |
| Colored Particles 12C | Latex (12) | C.I. Pigment Blue 15:3 | 0.965 | 0.031 | 3.2 | 6.2 |

Comparative Production Example 1Bk

Production of Suspension Polymerization Toner

Placed into a four-necked flask fitted with a high speed stirring unit (TK Homomixer) were 710 parts of deionized water and 450 parts of 0.1 mole/liter aqueous trisodium phosphate. The resulting mixture was heated to 65 ° C., and 68 parts of 1.0 mole/liter aqueous calcium chloride solution were gradually added at a stirring condition of 12,000 rpm, whereby a water based medium comprised of a dispersion containing colloidal trisodium phosphate was prepared.

On the other side, a dispersion was prepared by blending 14 parts of carbon black "Regal 330R" (produced by Cabot Corp.) with a monomer mixture solution consisting of 165 parts of styrene and 35 parts of n-butyl acrylate, and dispersing the resulting mixture employing a sand grinder. Thereafter, 60 parts of Exemplified Compound (20) were added to the resulting dispersion and dissolved at 80° C. Subsequently, 10 parts of 2,2'-azobis(2,4-dimethylvaleronitrile) as the polymerization initiator was added to the resulting mixture, whereby a monomer composition was prepared.

Said monomer composition prepared as above was gradually added to and dispersed in said water based medium at a stirring condition of 12,000 rpm. Subsequently, the resulting dispersing underwent polymerization under a nitrogen gas flow at 65° C. for 10 hours at a stirring condition of 200 rpm, employing said TK Homomixer in which the stirring blade had been replaced with ordinary one. When the polymerization reaction completed, hydrochloric acid was added and tricalcium phosphate, which was a dispersion stabilizer, was removed. Subsequently, comparative colored particles were obtained through filtration, washing, and drying. The colored particles obtained as above were designated as "Comparative Colored Particles 1Bk".

Comparative Production Example 1Y

Comparative colored particles, prepared by employing the suspension polymerization method, were obtained in the same manner as Comparative Production Example 1Bk, except that carbon black was replaced with pigment for yellow (C.I. Pigment Yellow 185) in an amount 14 parts. The colored particles prepared as above were designated as (Comparative "Colored Particles 1Y".

Comparative Production Example 1M

Comparative colored particles, prepared by employing the suspension polymerization method, were obtained in the same manner as Comparative Production Example 1Bk, except that carbon black was replaced with pigment for red (C.I. Pigment Red 122) in an amount 14 parts. The colored particles prepared as above were designated as (Comparative Colored Particles 1M".

Comparative Production Example 1C

Comparative colored particles, prepared by employing the suspension polymerization method, were obtained in the same manner as Comparative Production Example 1Bk, except that carbon black was replaced with pigment for blue (C.I. Pigment Blue 15:3) in an amount 14 parts. The colored particles prepared as above were designated as (Comparative Colored Particles 1C".

With each of Comparative Colored Particles 1Bk, 1Y, 1M, and 1C obtained as above, determined were the average of circularity (average circularity), the standard deviation of circularity, CV values of circularity, the volume average particle diameter, the peak molecular weight of high molecular weight components, the peak molecular weight of low molecular weight components, the molecular weight of an individual resin (number average molecular weight and weight average molecular weight). Table 5 below shows the results.

TABLE 5

| Colored Particles | Average Circularity | Standard Deviation of Circularity | CV Value of Circularity | Volume Average Particle Diameter (in μm) | Peak Molecular Weight: High Molecular Weight Components | Peak Molecular Weight: Low Molecular Weight Components | Molecular Weight of Individual Resin: Number Average Molecular Weight | Molecular Weight of Individual Resin: Weight Average Molecular Weight |
|---|---|---|---|---|---|---|---|---|
| Comparative Colored Particles 1Bk | 0.986 | 0.038 | 3.9 | 6.7 | 114,000 | — | 14,500 | 61,000 |
| Comparative Colored Particles 1Y | 0.982 | 0.035 | 3.6 | 6.5 | 114,000 | — | 14,500 | 61,000 |
| Comparative Colored Particles 1M | 0.985 | 0.039 | 4.0 | 6.9 | 114,000 | — | 14,500 | 61,000 |

TABLE 5-continued

| Colored Particles | Average Circularity | Standard Deviation of Circularity | CV Value of Circularity | Volume Average Particle Diameter (in μm) | Peak Molecular Weight: High Molecular Weight Components | Peak Molecular Weight: Low Molecular Weight Components | Molecular Weight of Individual Resin: Number Average Molecular Weight | Molecular Weight of Individual Resin: Weight Average Molecular Weight |
|---|---|---|---|---|---|---|---|---|
| Comparative Colored Particles 1C | 0.983 | 0.039 | 4.0 | 6.2 | 114,000 | — | 14,500 | 61,000 |

Comparative Production Example 2Bk

Colored Toner Production Employing the Kneading and Pulverization Method

One hundred parts of styrene-acryl resin, 10 parts of carbon black "Regal 330R" (produced by Cabot Corp.), and 10 parts of Exemplified Compound (20) were blended employing a Henschel mixer. Thereafter, the resulting mixture was melt kneaded employing a biaxial extruder, and subsequently pulverized employing a mechanical pulvelizer, and classified employing an air flow classifier to obtain comparative colored particles. Colored particles obtained as above were designated as "Comparative Colored Particles 2Bk".

Comparative Production Example 2Y

Comparative colored particles, prepared by employing the kneading and pulverization method, were obtained in the same manner as Comparative Production Example 2Bk, except that carbon black was replaced with pigment for yellow (C.I. Pigment Yellow 185) in an amount 10 parts. The colored particles obtained as above were designated as (Comparative Colored Particles 2Y".

Comparative Production Example 2M

Comparative colored particles, prepared by employing the kneading and pulverization method, were obtained in the same manner as Comparative Production Example 2Bk, except that carbon black was replaced with pigment for red (C.I. Pigment Red 122) in an amount 10 parts. The colored particles obtained as above were designated as (Comparative Colored Particles 2M".

Comparative Production Example 2C

Comparative colored particles, prepared by employing the kneading and pulverization method, were obtained in the same manner as Comparative Production Example 2Bk, except that carbon black was replaced with pigment for blue (C.I. Pigment Blue 15:3) in an amount 10 parts. The colored particles obtained as above were designated as (Comparative Colored Particles 2C".

With each of Comparative Colored Particles 2Bk, 2Y, 2M, and 2C obtained as above, determined were the average of circularity (average circularity), the standard deviation of circularity, CV values of circularity, the volume average particle diameter, the peak molecular weight of high molecular weight components, the peak molecular weight of low molecular weight components, the molecular weight of an individual resin (number average molecular weight and weight average molecular weight). Table 6 below shows the results.

TABLE 6

| Colored Particles | Average Circularity | Standard Deviation of Circularity | CV Value of Circularity | Volume Average Particle Diameter (in μm) | Peak Molecular Weight: High Molecular Weight Components | Peak Molecular Weight: Low Molecular Weight Components | Molecular Weight of Individual Resin: Number Average Molecular Weight | Molecular Weight of Individual Resin: Weight Average Molecular Weight |
|---|---|---|---|---|---|---|---|---|
| Comparative Colored Particles 2Bk | 0.936 | 0.119 | 12.7 | 6.3 | 234,000 | 16,000 | 5,800 | 43,000 |
| Comparative Colored Particles 2Y | 0.933 | 0.121 | 13.0 | 6.5 | 234,000 | 16,000 | 5,800 | 43,000 |
| Comparative Colored Particles 2M | 0.931 | 0.116 | 12.5 | 6.8 | 234,000 | 16,000 | 5,800 | 43,000 |
| Comparative Colored Particles 2C | 0.930 | 0.114 | 12.3 | 6.4 | 234,000 | 16,000 | 5,800 | 43,000 |

In Tables 1 through 6, "circularity" of colored particles (Colored Particles 1Bk through 12Bk, Colored Particles 1Y through 12Y, Colored Particles 1M through 12M. Colored Particles of 1C through 12C, Comparative Colored Particles 1Bk, 1Y, 1M, and 1C, and Comparative Colored Particles 2Bk, 2Y, 2M, and 2C) was determined under conditions of an analyzed sample amount of 0.3 μl and the number of detected particles of 1,500 to 5,000, employing an FPIA-1000 (produced by To a Iyodenshi Co.).

Hydrophobic silica (having a number average primary particle diameter of 12 nm as well as a degree of hydrophobicity of 68) and hydrophobic titanium (having a number average primary particle diameter of 20 nm as well as a degree of hydrophobicity of 63) were added to each of said colored particles so as to result in ratio of 1.2 percent by weight. No differences were found between each of colored particles and each of the resulting toners with respect to the shape, the particle diameter, and the like.

Each of toners 1 obtained as above was blended with a silicone coated ferrite carrier having a volume average particle diameter of 60 μm so as to result in toner concentration of 6 percent by weight. Thus developers were prepared. The resulting developers were designated as Developers 1Bk through 12Bk, Developers 1Y through 12Y, Developers 1M through 12M, Developers 1C through 12C, corresponding to Colored Particles 1Bk through 12Bk, Colored Particles 1Y through 12Y, Colored Particles 1M through 12M, Colored Particles 1C through 12C, respectively.

coating amount of said silicone oil was adjusted to 0.6 mg/A4 sized sheet. This was designated as "Fixing Unit 1".

Fixing Units 2 through 9

Based on Table 7 below, Fixing Units 2 through 9 were prepared in which at lease one condition of the Asker C hardness and the thickness of the surface covering layer (silicone rubber) of the heating roller; the Asker C hardness and the thickness of the surface covering layer (silicone rubber) of the pressure roller; and the contact load (total load), the nip width, and the coated amount of silicone oil was different from Fixing Unit 1.

TABLE 7

| | Surface Covering layer (silicone rubber) of Heating Roller | | Surface Covering layer (silicone rubber) of Pressure Roller | | Total | | Supplied Amount of Silicone |
|---|---|---|---|---|---|---|---|
| | Asker hardness C | Thickness (in mm) | Asker hardness C | Thickness (in mm) | Load (in N) | Nip Width (in mm) | Oil (in mg/A4) |
| Fixing Unit 1 | 30 | 8 | 30 | 2 | 150 | 6.6 | 0.6 |
| Fixing Unit 2 | 26 | 5 | 30 | 4 | 150 | 6.6 | 0.3 |
| Fixing Unit 3 | 15 | 3 | 30 | 3 | 150 | 6.6 | 0.5 |
| Fixing Unit 4 | 1 | 2 | 55 | 2 | 150 | 7.0 | 0.3 |
| Fixing Unit 5 | 1 | 3 | 20 | 2 | 150 | 7.0 | 0 |
| Fixing Unit 6 | 30 | 4 | 30 | 2 | 200 | 5.6 | 0.6 |
| Fixing Unit 7 | 75 | 2 | 30 | 4 | 200 | 5.6 | 0.6 |
| Fixing Unit 8 | 30 | 4 | 80 | 2 | 200 | 5.6 | 0.4 |
| Fixing Unit 9 | 75 | 5 | 75 | 5 | 250 | 4.5 | 0.4 |

Preparation of Fixing Unit

Pressure contact system fixing units (Fixing Units 1 through 9), as shown in FIG. 1, were prepared.

Fixing Unit 1

A heating roller (an upper roller) was prepared by covering the surface of an aluminum alloy cylinder (having an interior diameter of 30 mm, a wall thickness of 1.0 mm, and a total length of 310 mm), having a heater at the central section, with sponge-like silicone rubber (having an Asker C hardness of 30 degrees and a thickness of 8 mm). On the other hand, a pressure roller (a lower roller) was prepared by covering the surface of iron cylinder (having an interior diameter of 40 mm and a wall thickness of 2.0 mm) with a sponge-like silicone rubber (having an Asker hardness of 30 degrees and a thickness of 2 mm). Said heating roller was brought into contact with said pressure roller under an application of total load of 150 N to form a nip having a width of 6.6 mm. Employing said fixing unit, a linear speed for printing was set at 180 mm/second. Further, employed as a cleaning mechanism was a supply method of a web system impregnated with polydiphenylsilicone (having a viscosity of 10 Pa·s at 20° C.). Fixing temperature was controlled by the surface temperature of said heating roller. Further, the Examples 1 through 17 and Comparative Examples 1 through 3

Based on combinations shown in Table 8 below, each of developers (nBk/nY/nM/nC: wherein n is any integer of 1 to 12) was employed in a digital color copier "Konica 3015" (produced by Konica Corp.) provided with each of said Fixing Units 1 through 9, and practical printing was carried out to evaluate fixability (the fixing ratio of halftone) as well as offsetting resistance (back staining), and to determine the chroma of the secondary color of green as well as standard glossiness.

Incidentally, the surface temperature of the heating roller in the fixing unit was set at 175° C. at the center. Development conditions as well as evaluation methods are as follows.

(Development Conditions)

Photoreceptor: lamination type organic photoreceptor

DC bias: −500 V

Dsd (distance between the photoreceptor and the development sleeve): 600 μm

Developer layer regulation: magnetic H-Cut system

Developer layer thickness: 700 μm

Development sleeve diameter: 40 mm (Evaluating Methods)

(1) Fixability

Halftone images (having a relative reflection density of 1.0 when the density of a paper sheet is 0), in which each of Y/M/C/Bk was printed employing a single color, were printed and fixing ratio was determined.

The fixing ratio was obtained as follows. A fixed image was rubbed employing 1 kg weight wrapped with bleached cotton cloth, and image density before and after rubbing was measured. Then the fixing ratio was determined employing the formula described below. Table 9 below shows the results.

Fixing ratio (in percent)=[image density after rubbing]/(image density before rubbing)]×100

(2) Back Staining

A full-color image (having a pixel ratio of 50 percent) was continually printed onto 1,000 sheets (this operation was designated as 1 cycle). Then 10-cylce operation was performed. Further, at every cycle, said copier rested over night.

During the operation, at the completion of each cycle, the presence and absence of staining and the magnitude of staining on the back (back staining) were visually evaluated, and ranked to A through C, based the criteria described below.

Table 9 below shows the number of cycles which reached Rank C (generation frequency of Rank C) and staining rank at the completion of 10 cycles (staining rank at 10 times operation).

Rank A: no staining results

Rank B: slight staining results which is commercially viable

Rank C: staining is visually noticed, which results in a commercial unviable product.

(3) Chroma of Secondary Color of Green

During the formation of the full-color image in (2) above (1,000 sheets×10 cycles), the chroma of the secondary color of green of an initial copied image (first copy of 1 cycle) and a last copied image (1,000th copy at 10 cycles) was determined employing "Mcbeth Color Eye", and color reproduction was evaluated. Herein, evaluation was carried out at a light source viewing field of 2 degrees (ASTM-D 65) and an SCE mode.

(4) Standard Glossiness

During the formation of full-color images in (2) above, the standard glossiness of an initial copied image (first copy of 1 cycle) was determined employing the aforementioned method.

Table 9 below shows the results.

TABLE 8

| | Developer | Fixing Unit |
|---|---|---|
| Example 1 | Developer 1Bk/1Y/1M/1C | Fixing Unit 1 |
| Example 2 | Developer 2Bk/2Y/2M/2C | Fixing Unit 1 |
| Example 3 | Developer 3Bk/3Y/3M/3C | Fixing Unit 1 |
| Example 4 | Developer 4Bk/4Y/4M/4C | Fixing Unit 1 |
| Example 5 | Developer 5Bk/5Y/5M/5C | Fixing Unit 1 |
| Example 6 | Developer 6Bk/6Y/6M/6C | Fixing Unit 1 |
| Example 7 | Developer 7Bk/7Y/7M/7C | Fixing Unit 1 |
| Example 8 | Developer 8Bk/8Y/8M/8C | Fixing Unit 1 |
| Example 9 | Developer 9Bk/9Y/9M/9C | Fixing Unit 1 |
| Example 10 | Developer 10Bk/10Y/10M/10C | Fixing Unit 1 |
| Example 11 | Developer 11Bk/11Y/11M/11C | Fixing Unit 1 |
| Example 12 | Developer 12Bk/12Y/12M/12C | Fixing Unit 1 |
| Example 13 | Developer 1Bk/1Y/1M/1C | Fixing Unit 2 |

TABLE 8-continued

| | Developer | Fixing Unit |
|---|---|---|
| Example 14 | Developer 1Bk/1Y/1M/1C | Fixing Unit 3 |
| Example 15 | Developer 1Bk/1Y/1M/1C | Fixing Unit 4 |
| Example 16 | Developer 1Bk/1Y/1M/1C | Fixing Unit 5 |
| Example 17 | Developer 1Bk/1Y/1M/1C | Fixing Unit 6 |
| Comparative Example 1 | Developer 1Bk/1Y/1M/1C | Fixing Unit 7 |
| Comparative Example 2 | Developer 1Bk/1Y/1M/1C | Fixing Unit 8 |
| Comparative Example 3 | Developer 1Bk/1Y/1M/1C | Fixing Unit 9 |

TABLE 9

| | Fixing Ratio | Back Staining | | Standard Glossiness | Chroma of Green | |
|---|---|---|---|---|---|---|
| | | Generation Frequency | Staining Rank after 10 | | | |
| | (%) | of Rank C | Cycles | (initial) | Initial | End |
| Example 1 | 95 | — | Rank A | 22 | 63 | 63 |
| Example 2 | 93 | — | Rank A | 22 | 63 | 63 |
| Example 3 | 96 | — | Rank A | 21 | 64 | 64 |
| Example 4 | 96 | — | Rank A | 21 | 64 | 64 |
| Example 5 | 92 | — | Rank B | 23 | 64 | 64 |
| Example 6 | 92 | — | Rank A | 22 | 65 | 65 |
| Example 7 | 94 | — | Rank A | 22 | 64 | 64 |
| Example 8 | 92 | — | Rank A | 22 | 64 | 64 |
| Example 9 | 97 | — | Rank A | 21 | 62 | 62 |
| Example 10 | 96 | — | Rank A | 23 | 61 | 61 |
| Example 11 | 89 | — | Rank A | 21 | 61 | 61 |
| Example 12 | 97 | — | Rank A | 21 | 61 | 61 |
| Example 13 | 91 | — | Rank A | 19 | 63 | 63 |
| Example 14 | 96 | — | Rank A | 19 | 64 | 64 |
| Example 15 | 94 | — | Rank A | 18 | 63 | 63 |
| Example 16 | 98 | — | Rank B | 25 | 62 | 62 |
| Example 17 | 97 | — | Rank A | 25 | 62 | 62 |
| Comparative Example 1 | 82 | 9th | Rank C | 24 | 53 | 53 |
| Comparative Example 2 | 83 | 9th | Rank C | 24 | 53 | 53 |
| Comparative Example 3 | 83 | 9th | Rank C | 24 | 52 | 52 |

The toner of the present invention makes it possible to form color images which exhibit excellent fixability and offsetting resistance as well as excellent color reproduction even when employed in an image forming method comprising a fixed color image forming process employing a fixing unit to which silicone oil is not supplied or only a very small amount of silicone oil is supplied.

The image forming method of the present invention makes it possible to form no offset phenomena, and form images which exhibit a high fixing ratio as well as excellent color reproduction properties for an extended period of time, even when employed in an image forming method comprising a fixed color image forming process employing a fixing unit to which silicon oil is not supply or only a very small amount of silion oil is supplied.

What is claimed is:

1. An image forming method comprising developing an electrostatic latent image formed on a photoreceptor to form a toner image employing a developer comprising a toner, transferring the toner image onto an image forming material, and fixing the transferred toner image employing a fixing unit, wherein the fixing unit comprises a heating roller and a pressure roller which is brought into contact with said heating roller, the heating roller is comprised of a cylinder having an interior diameter of from 10 to 70 mm and a wall thickness of from 0.1 to 2 mm comprised of a metal or a metal alloy, and a heating member being incorporated in the interior, a surface of the cylinder being covered with an elastic material having an Asker hardness C of less than 70 degrees at a thickness of 0.1 to 30 mm, and the pressure roller is comprised of a metal cylinder whose surface is covered with an elastic material having an Asker hardness C of less than 80 degrees at a thickness of from 0.1 to 30 mm.

2. The image forming method of claim 1 wherein the Asker C hardness of elastic material of the pressure roll is less than 70 degrees.

3. The image forming method of claim 2 wherein the Asker C hardness of elastic material of the pressure roll is less than 60 degrees.

4. The image forming method of claim 1 wherein the cylinder of the heating roller is comprised of iron, aluminum, copper, or alloy thereof.

5. The image forming method of claim 1 wherein elastic material of the cylinder of the heating roller is silicone rubber, fluorine rubber or silicone foamed rubber.

6. The image forming method of claim 1 wherein the Asker C hardness of elastic material of the heating roller is less than 60 degrees.

7. The image forming method of claim 1, wherein the toner comprises at least of a binder resin, a colorant, and a releasing agent, and is obtained by salting out/fusing resin particles comprising the releasing agent in binding resin and colorant particles.

8. The image forming method of claim 7 wherein the releasing agent is represented by Formula (1), $$R^1—(OCO—R^2)_n \quad (1)$$

wherein $R^1$ and $R^2$ each represent a hydrocarbon group having from 1 to 40 carbon atoms which may have a substituent, and n represents an integer of 1 to 4.

9. The image forming method of claim 7 wherein elastic material of the cylinder of the heating roller is silicone rubber, fluorine rubber or silicone foamed rubber.

10. The image forming method of claim 7 wherein the Asker C hardness of elastic material of the heating roller is less than 60 degrees and the Asker C hardness of elastic material of the pressure roll is less than 60 degrees.

11. The image forming method of claim 10 wherein the releasing agent is represented by the General Formula (1), $$R^1—(OCO—R^2)_n \quad \text{General Formula (1)}$$

wherein $R^1$ represents a hydrocarbon group having from 1 to 80 carbon atoms, which may have a substituent, or a group represented by formula of $(LK_1—X—LK_2)_m—$, wherein $LK_1$ and $LK_2$ represent a hydrocarbon group, which may have a substituent, and $LK_1$ and $LK_2$ may be same or different, m is a natural number of 1 or more, X represents O or —OCO—, $R^2$ represents a hydrocarbon group having from 1 to 80 carbon atoms, which may have a substituent, and n represents an integer of 1 to 15.

12. The image forming method of claim 10 wherein content ratio of releasing agent in the toner is 1 to 30 percent by weight.

13. The image forming method of claim 1 wherein silicone oil is supplied to the heating roller in amount of not more than 2 mg per A4 sized sheet of paper.

14. An image forming apparatus comprising developing unit, a photoreceptor, transferring unit, and fixing unit, wherein the developing unit contains toner comprising at least of a binder resin, a colorant, and a releasing agent, and is obtained by salting out/fusing resin particles comprising the releasing agent in binding resin and colorant particles, the fixing unit comprises a heating roller and a pressure roller which is brought into contact with said heating roller, the heating roller is comprised of a cylinder having an interior diameter of from 10 to 70 mm and a wall thickness of from 0.1 to 2 mm comprised of a metal or a metal alloy, and a heating member being incorporated in the interior, a surface of the cylinder being covered with an elastic material having an Asker hardness C of less than 70 degrees at a thickness of 0.1 to 30 mm, and the pressure roller is comprised of a metal cylinder whose surface is covered with an elastic material having an Asker hardness C of less than 80 degrees at a thickness of from 0.1 to 30 mm.

* * * * *